US008387789B2

(12) United States Patent
Baker

(10) Patent No.: US 8,387,789 B2
(45) Date of Patent: Mar. 5, 2013

(54) ENCASEMENT PROTECTIVE APPARATUS

(76) Inventor: Roger James Baker, Aurora, CO (US)

( * ) Notice: Subject to any disclaimer, the term of this patent is extended or adjusted under 35 U.S.C. 154(b) by 140 days.

(21) Appl. No.: 12/945,833

(22) Filed: Nov. 13, 2010

(65) Prior Publication Data

US 2012/0118766 A1 May 17, 2012

(51) Int. Cl.

| | |
|---|---|
| ***B65D 85/20*** | (2006.01) |
| ***B65D 81/02*** | (2006.01) |
| ***B65D 81/20*** | (2006.01) |
| ***B65D 85/30*** | (2006.01) |

(52) U.S. Cl. ..... 206/315.1; 206/521; 206/524.8; 206/594

(58) Field of Classification Search ..... 150/154; 206/315.1, 0.5, 521, 524.8, 591, 592, 594, 206/584; 5/911; 602/6
See application file for complete search history.

(56) References Cited

U.S. PATENT DOCUMENTS

| | | | | |
|---|---|---|---|---|
| 3,232,289 | A * | 2/1966 | Zimmerman | 602/6 |
| 3,745,998 | A | 7/1973 | Rose | |
| D261,430 | S | 10/1981 | Baturin | |
| 4,483,380 | A | 11/1984 | Beran | |
| 4,640,080 | A * | 2/1987 | Wright | 53/449 |
| 4,657,003 | A | 4/1987 | Wirtz | |
| 4,848,364 | A * | 7/1989 | Bosman | 128/849 |
| 5,094,344 | A | 3/1992 | Savage | |
| 5,121,756 | A * | 6/1992 | Koledin | 5/628 |
| 5,147,235 | A | 9/1992 | Bamburak et al. | |
| 5,154,185 | A | 10/1992 | Latimer | |
| 5,163,550 | A | 11/1992 | Hawk | |
| 5,193,677 | A | 3/1993 | Moreno | |
| 5,351,830 | A * | 10/1994 | Bender et al. | 206/524.8 |
| 5,595,806 | A * | 1/1997 | Korfmacher | 428/69 |
| 5,788,078 | A * | 8/1998 | Fuss | 206/521 |
| 5,826,583 | A | 10/1998 | Wood | |
| 5,855,207 | A * | 1/1999 | Moenning et al. | 128/845 |
| 6,226,820 | B1 * | 5/2001 | Navarro | 5/655.5 |
| 6,453,477 | B1 * | 9/2002 | Bainbridge et al. | 2/455 |
| 7,017,747 | B2 | 3/2006 | Kiger et al. | |
| 7,273,462 | B2 | 9/2007 | Rugfelt et al. | |
| 2004/0082891 | A1 | 4/2004 | Daugherty et al. | |
| 2007/0125671 | A1 | 6/2007 | Stephens | |
| 2008/0289640 | A1 | 11/2008 | Kline | |
| 2010/0006469 | A1 | 1/2010 | Allouche | |

* cited by examiner

*Primary Examiner* — J. Gregory Pickett
*Assistant Examiner* — Kaushikkumar Desai
(74) *Attorney, Agent, or Firm* — Roger A. Jackson

(57) ABSTRACT

A protective apparatus for an article, the apparatus including a surrounding sidewall having a first end portion and an opposing second end portion, the sidewall also having a perpendicularly oriented first margin portion and an opposing second margin portion, also with a primary interior. The interior includes a plurality of first and second chambers that are intersticed in position to one another. In addition, included is a plurality of particulate items loosely disposed within each of the first and second chambers and a structure for removable engagement positioned adjacent to the first and second margins. The removable engagement structure facilitates the first and second margins to be removably engaged allowing the surrounding sidewall to envelope the article. The primary interior can be evacuated, thus removing the air spaces between the particulate items and in the interior resulting in rigidifying the surrounding sidewall, thus protecting the article.

4 Claims, 19 Drawing Sheets

ENCASEMENT PROTECTIVE APPARATUS

FIELD OF THE INVENTION

The present invention generally relates to protective covers and cases for articles. More particularly, the present invention discloses protective covers for sport type boards, namely surfboards, wakeboards, snowboards, and the like that are planar in nature, wherein the sportboard is normally transported to a destination to be used. The sportboard by its nature can be somewhat fragile due to having a relatively thin cross section to its length and width and further given that during the transportation phase, the sport board in frequently loaded with a multitude of other items that can play particular havoc with the outer periphery of the sportboard being vulnerable to damage from adjacent cargo, particularly puncturing a soft core of the sportboard or damaging the external finish and graphics of the sportboard.

DESCRIPTION OF THE RELATED ART

Up until now there have been relatively moderate efforts in designing and manufacturing a fully engineered protective cover for sportboards, a number of the current protective covers available for sportboards to the consumer appear to be design afterthoughts in that they are nothing any more special than a typical backpack or a laptop bag in basic construction. The typical protective cover has a zippered enclosure with a soft foam padded lining with a nylon type fabric cover, wherein the protective cover loosely fits around the sportboard. The current other protective cover materials available are typically various forms of corrugated cardboard, bubble wrap, or sheet foam padding that at the very best only moderately protect the sportboard, this being primarily due to the packaging and protective cover materials being inherently soft and flexible and also fitting around the outer surface of the sportboard in a very loose manner, due to the protective cover attempting to fit a wide variety of sportboard sizes.

What this results in that if another piece of cargo or transport vehicle wall becomes adjacent to the board during shipping or transport and comes in contact with the currently available protective cover, the cover firstly will not have any structural rigidity to resist any sort of point impact to protect the sport board, and secondly with the relative movement being allowed to the sportboard within the cover during the normal shipping inertia loads, the board will tend to bang around especially on its outer periphery against the inside of the protective cover allowing further damage to the outer periphery of the sportboard and again causing potential damage to the surface finish and graphics of the sportboard, this is especially critical in that this shifting of the sportboard within the protective cover during transit is highly cyclical, i.e. occurring numerous times (in the thousands), thus the aforementioned damage can become cumulative in nature.

Therefore, two very basic desirable things come to light to maximize the shipping and transport protection given to the sportboard. The first desirable thing is "structural rigidity", in other words the protective cover should be able to handle a point load impact and be able to handle a bending load imposed upon the sport board along its longest axis from end to end. Wherein the aforementioned point load impact and bending load are placed upon the exterior of the protective cover, the protective cover would have the rigidity to absorb the brunt of this external loading by being its own rigid structure, thus not transmitting these external protective cover loads to the sport board itself. The second desirable thing for the protective cover is to have a very snug and close-fitting fit to the exterior surface of the sportboard, that absolutely minimizes the relative movement of the sportboard within the protective cover during transport or shipment. As this snug fitting concept will go a long way toward preventing the previously described high-frequency occurrence and cumulative damage to either the exterior surface finish and graphics of the sportboard or damage to the exterior surfaces being principally upon the outer periphery of the sportboard.

The well know problem to accomplishing the above two mentioned things for a protective cover typically require a totally custom made hard shell enclosure that has an interior that is also custom fit to the external surface of the sportboard, as is typically used in specialized cases made for high value electronic equipment that is frequently shipped or transported frequently. To address one of these two things, the prior art in differing art areas has used air pressure to create temporary rigidity in structures, wherein as long as the air negative or positive pressure remains in place the normally flexible structure is rigid, with the structure becoming flexible once again when the air negative or positive pressure returns to atmospheric pressure. To address the close fitting requirement, the prior art has had solutions that are permanent, such as expandable polyurethane foam, that can certainly precisely encase an article's unique external shape for shipping without any relative movement of the article in the foam casing, however, the foam casing being permanent and not reusable, thus being acceptable for one time shipping from factory to user, however, not being acceptable for multiple transport scenarios, where the sportboard is transported multiple times to its site of usage.

Starting in the prior art for an air rigid type apparatus with United States Patent Application No. 20080289640 to Kline disclosed a vacuum activated device for holding a human immobile. The device includes a rigid frame of a three dimensional shape large enough to surround a human torso and a bag comprised of a flexible, air impermeable material enclosing the frame. A closure on the bag is necessary to allow an occupant to enter or be placed within it. When air is evacuated through a hole in the bag its surface will collapse around the frame and the occupant's body. The rigidity of the frame in combination with the pressure applied to the occupant by the surface of the bag will impede further movement by the occupant. A means to allow the occupant access to breathable air will be provided, see abstract.

Continuing in the prior art for air rigid apparatus in U.S. Pat. No. 7,273,462 (2007) to Rugfelt, et al. disclosed an apparatus for supported and stabilized an injured person or an injured limb, with a flexible film element enclosing an airtight inner region that can be evacuated. The film element is provided with two insertion bodies which respectively are formed with two air-permeable, flexible material strips. Each insertion body is divided into chambers containing loose particles, by way of intersecting seams formed between the material strips. The seams on both insertion bodies are staggered in relation to each other in both directions in such a way that the particles combine to form a substantially homogenously thick particle layer.

Further in the prior art in this same area of air pressure rigid structures in U.S. Pat. No. 3,745,998 (1973) to Rose disclosed is an emergency immobilization and extrication device similar to Rugfelt except that the longitudinal chambers are used for the particulate filler to enhance lengthwise rigidity for the limb, further a system of foraminous distribution between chambers for vacuuming is disclosed along with soft and irregular particulate matter being claimed as forming a more rigid structure when subjected to a vacuum pressure. Next in the prior art again for solidifying flexible structures via air is in U.S. Pat. No. 5,154,185 (1992) to Latimer that discloses an emergency immobilization device that allows the particulate materials to be manually shifted to provided additional stiffening in selected areas of the support. Further, in the prior art for air rigidity structures in U.S. Pat. No. 4,657,003 (1987) to Wirtz disclosed is an emergency immobilization device similar to Latimer in function, wherein the particulate materials are to be manually shifted to provide additional stiffening in selected areas of the support, with a different interior chamber system.

Also in the prior art for air rigid based structures, in U.S. Pat. No. 5,826,583 (1998) to Wood disclosed is an emergency immobilization and extrication device that permits a victim of spinal column trauma to be firmly supported and immobilized for transportation. The device in Wood comprises a container filled with a multiplicity of small, resilient particles resting in a light-weight rigid base-board, and having a sliding rigid cover. The container in Wood comprises means for inflating with gas and deflating, see abstract. Wood claims "flexible sub-containers in the shape of a human body" within the device, where each sub-container is filled with a plurality of deformable and resilient particles, having container perforations sufficiently small so that the gas but not the particles may travel freely from one sub-container to another, see column 6, lines 2-7.

Next, in the prior art for air rigid devices, in United States Patent Application No. 20040082891 to Daugherty, et al. disclosed a vacuum splint device for securely immobilizing an injured limb or other body part. The device in Daugherty et al., includes a plurality of T-shaped straps for insertion through slots on the sleeve of the device. Each strap in Daugherty et al., may be folded over the slots and back upon itself to fasten the end of the strap to the device. The sleeve of the Daugherty et al., device includes a plurality of particles that are initially separated by air to allow for the device to be flexible. Once placed on the injured body part, the air may be removed from the Daugherty et al., device using an intake/exhaust valve tube assembly to compress the particles together to form a substantially rigid sleeve. A filter in Daugherty et al., is on the valve tube assembly to ensure that the particles remain within the sleeve. Once the air is removed from the Daugherty et al., device, a clamp may be used on the tube of the valve tube assembly to prevent any air from flowing into the tube. Upon removal of the Daugherty et al., device from the injured limb, the straps may be removed from the device for replacement or washing. Air may be introduced into the sleeve by undoing the clamp so as to allow air to reenter the interior in the Daugherty et al., device and separate the particles and allow the device to be folded. Also in the prior art area for what is termed "vacuum splints" in U.S. Design Pat. No. D261,430 (1981) to Baturin disclosed is the ornamental design for a vacuum splint having a mattress shape where the particles inside the split are divided into circumferential chambers, and two primary chambers exist along the length of the mattress, and several additional chambers exist along the width of the mattress, see FIGS. 1, 4, and 6, note that this is a design patent, and thus cannot really teach the function of how the invention works.

Next looking in the prior art at sportboard specific protective covers in United States Patent Application No. 20070125671 to Stephens disclosed is an industry standard packaging design to ship and protect surfboards, wakeboards, snowboards, kiteboards, etc. in various sizes. Stephens uses corrugated die-cut end caps, flexible straps, and foam and corrugated pads to provide enhanced fragility protection in an easy to assemble/disassemble and reusable package. This package in Stephens makes it possible to ship expensive board products around the world safely and cost effectively for OEM Bulk and retail single/bulk deliveries, see abstract, however, not really being designed to be reusable for multiple transportation use scenarios.

Continuing in this prior art area for sportboard specific protective covers in United States Patent Application No. 20100006469 to Allouche disclosed is a surfboard case that includes a body which has an interior that is structured to stretchably adapt to a surfboard having a predetermined shape and size. The body in Allouche is further structured to substantially cushion an impact to the surfboard contained within the surfboard case. In at least one instance, a substantial portion of the surfboard case comprises a neoprene material of construction. The surfboard case in Allouche also includes at least one reinforcement section disposed in protective relation to a predetermined portion of the surfboard, see abstract.

Further, in this prior art area for sportboard specific protective covers in U.S. Pat. No. 4,483,380 (1984) to Beran disclosed is a foldable protective cover and carrier for sports equipment. The cover in Beran includes an outer layer of protective material such as nylon and an inner layer of cushioning material such as foam plastic. A pocket in Beran is provided at each longitudinal end of the cover at the inner side, and four laterally extending straps are spaced along the outer layer of material with two straps being at the longitudinal ends and the other two inwardly thereof. Reinforcing strips in Beran extend laterally across the longitudinal ends of the cover and a third reinforcing strip having a fifth strap connected therewith extends between the inwardly positioned straps to form a handle at one side edge when the cover is fully assembled. Sports equipment, such as a surfboard, is placed on the inner side of the unfolded cover in Beran, preferably with the bottom facing upwardly, and the cover is folded over a surfboard in an overlapping fashion to provide a dual layer of protection for the bottom of the board The pair of inwardly positioned straps in Beran are the fastened about the board, after which the ends of the cover are folded around the board ends in such a manner that the dual layer of protection wraps continuously around the nose and tail of the board, after which the end straps are fastened, see abstract.

Continuing in this prior art area of sportboard protective covers in U.S. Pat. No. 5,147,235 (1992) to Bamburak, et al., disclosed a protective cover for a surfboard or the like that has a cushioned end with protective pockets to enclose the fin(s), and also can cover an end of the surfboard. The fin-receiving pockets in Bamburak, et al., are formed between air-filled plenums or bodies of shock-absorbing material such as foam. A closure strap in Bamburak, et al., can encircle the surfboard for holding the protective cover in place, or a zipper closure can be provided, see abstract. Next, in the sportboard cover protective arts in U.S. Pat. No. 7,017,747 (2006) B2 to Kiger, et al. disclosed is a protective surfboard covering device including a cover that defines a plurality of inflatable cushions that may include a top surface cushion, a bottom surface cushion, and a pair of laterally spaced apart sidewall cushions, the cushions defining therebetween a surfboard compartment and cooperating to form a mouth through which the surfboard is inserted into the surfboard compartment, see abstract. Note, that in Kiger et al., using positive air pressure for rigidity is generally not as preferable as using negative air pressure with particulate matter, due to the situation when the air pressure is lost then for the positive pressure device as in Kiger et al., all cushioning and rigidity is lost, wherein with the negative pressure device such as a vacuum splint in Rose, wherein loss of air pressure will still result in some cushioning and rigidity of the device.

Moving ahead in the sportboard protective cover arts, in U.S. Pat. No. 5,193,677 (1993) to Moreno disclosed a surfboard storage and carrying bag with a pneumatically inflated guard rail comprising of three circumferential tubes with each pneumatically inflated and attached inside a surfboard storage or carrying bag that when inflated provides a guard rail or bumper to protect the surfboard. Moreno also describes an inflatable pillow that protects fin protrusions, see abstract. Moreno would have the same problems as Kiger et al., is using a positive air pressure to add rigidity and cushioning to the protective cover. Next, in the sportboard protective cover arts, U.S. Pat. No. 5,094,344 (1992) to Savage disclosed is a surfboard carry case that includes a soft portion and a rigid hard portion, structured such that at least one surfboard can be carried therein, with a tail portion of the surfboard, including the fins, protectively encapsulated within the hard case portion, see abstract.

Continuing, in the sportboard protective cover arts in U.S. Pat. No. 5,163,550 (1992) to Hawk disclosed is a protective cover for snowboards comprising an elastic elongated panel having an elastic cord around its outer peripheral edge which must be stretched in order to permit insertion of the snowboard such that the bottom of the snowboard is covered by the panel and the elastic cord snugly engages the top surface of the panel; and reinforcing layers are provided along the surrounding edge of the panel to overlap the edges of the snowboard, see abstract. Noting that Hawk recognizes the importance of protecting the outer periphery of the sportboard from damage.

What is needed is a protective cover that accomplishes is two very basic desirable things to maximize the shipping and transport protection given to the sportboard. The first desirable thing is "structural rigidity", in other words the protective cover must be able to handle a point load impact and be able to handle a bending load imposed upon the sport board along its longest axis from end to end. Wherein the aforementioned point load impact and bending load are placed upon the exterior of the protective cover, wherein the protective cover will absorb stand up to the brunt of this external loading by being its own rigid structure, thus not transmitting these external protective cover loads to the sport board itself. The second desirable thing for the protective cover is to have a very snug and close-fitting fit to the exterior surface of the sportboard, that's absolutely minimizes the relative movement of the sportboard in the protective cover during transport or shipment. As this snug fitting concept will go a long way toward preventing the previously described high-frequency occurrence and cumulative damage to either the exterior surface finish and graphics of the sportboard or damage to the exterior surfaces being principally upon the outer periphery of the sportboard.

Therefore the challenge of the present invention is to have a protective cover apparatus that can custom fit itself to a multitude of different size sportboards and to have the structural rigidity necessary to adequately protect the sportboard, while at the same time having the ability to be used with a number of different sizes of sportboards and being desirably flexible for storage and handling when the protective cover apparatus of the present invention does not have a sport board disposed within it.

SUMMARY OF INVENTION

Broadly, the present invention is of an encasement protective apparatus for enveloping an article, the article having a lengthwise axis, with the apparatus including a flexible surrounding sidewall about a longitudinal axis, wherein the surrounding sidewall has a first end portion and an opposing second end portion with the longitudinal axis spanning therebetween. The surrounding sidewall also having a first margin portion and an opposing second margin portion, wherein the first and second margin portions are substantially parallel to the longitudinal axis, with the surrounding sidewall also having an outer surface portion and an inner surface portion. The inner surface portion is attached at the first and second end portions, thereby the inner surface portion defining a primary interior that is substantially fluid tight, as the surrounding sidewall generally forms a substantially rectangular prism shape with an outer periphery element defined by the first and second end portions and the first and second margins. Further included in the apparatus is a plurality of flexible first chambers disposed within the primary interior, wherein the first chambers are adjacent to one another and positioned in rows along the longitudinal axis.

Also included in the apparatus is a plurality of flexible second chambers disposed within the primary interior, wherein the second chambers are adjacent to one another and positioned in rows along the longitudinal axis. The rows of first and second chambers are intersticed in positional orientation to one another in position such that an outer edge of a second chamber lies midway over a first chamber width, resulting that an ancillary axis positioned perpendicular to the longitudinal axis would intersect at least one of the first or second chambers at any position within the primary interior. In addition, included is a plurality of particulate items loosely disposed within each of the first and second chambers and a means for removable engagement positioned adjacent to a part of the outer periphery element. Wherein operationally the means of removable engagement facilitates the part of periphery element to be removably engaged to itself allowing the surrounding sidewall to completely envelope the article about the lengthwise axis in an engaged operational state. The longitudinal axis and the lengthwise axis are substantially parallel to one another in the engaged operational state, wherein disengagement of the means for removable engagement releases the article from being completely enveloped by the surrounding sidewall in a disengaged operational state.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
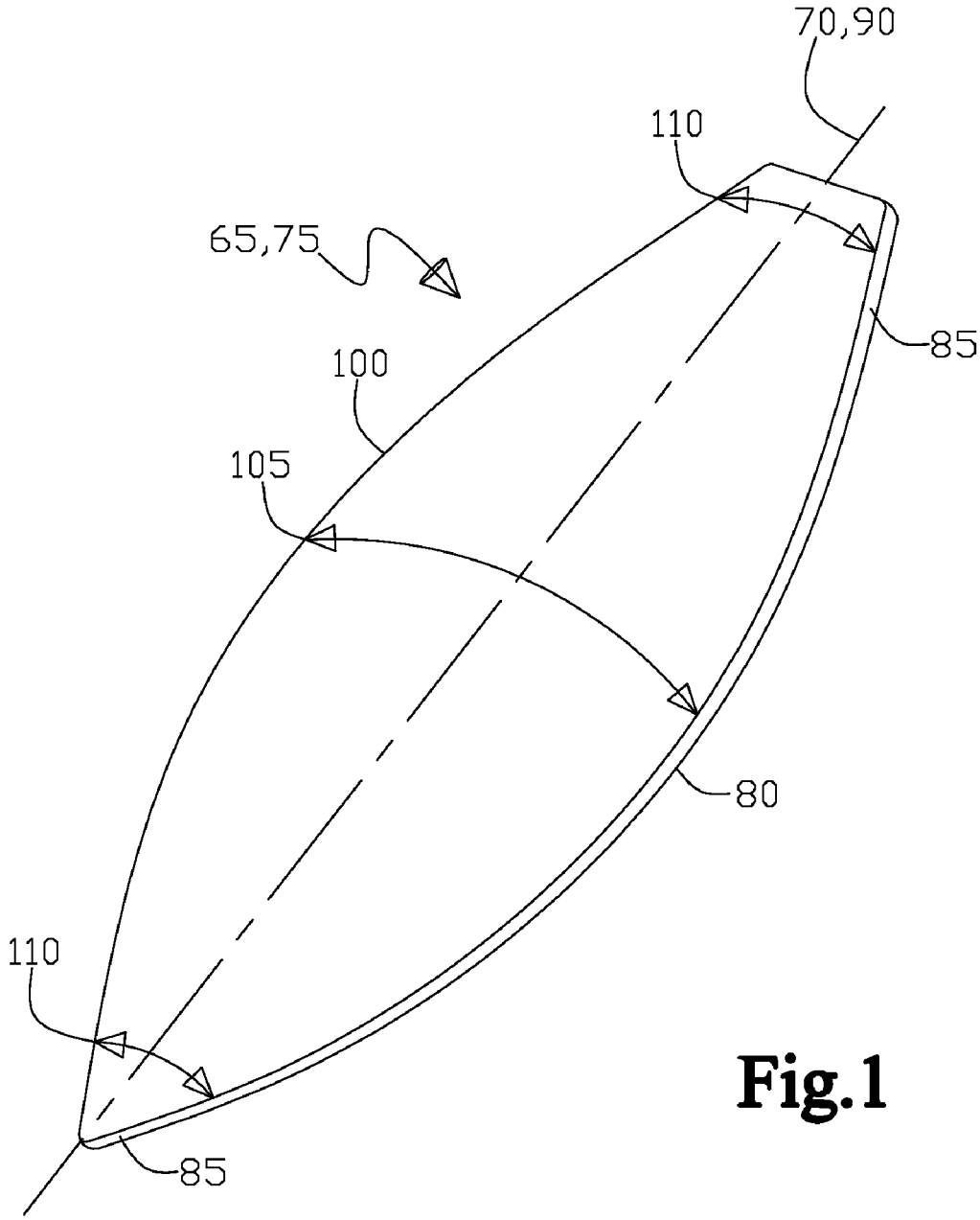
FIG. 1 shows a typical article or sportboard with the lengthwise axis, the central portion, the opposing end portions, the outer periphery, the wider periphery at the central portion, and the narrower periphery at the opposing end portions.

50 Encasement protective apparatus
55 Protective case for a sportboard
56 Prior art sportboard cover
60 External environment
65 Article
70 Lengthwise axis of the article 65
75 Sportboard
80 Central portion of the sportboard 75
85 Opposing end portions of the sportboard 75
90 Lengthwise axis for the sportboard 75

100 Outer periphery of the sportboard 75
105 Wider periphery at a central portion 80 of the sportboard 75
110 Narrower periphery at the opposing end portions 85 of the sportboard 75
115 Flexible surrounding sidewall
120 Longitudinal axis of the surrounding sidewall 115
125 First end portion of the surrounding sidewall 115
130 Second end portion of the surrounding sidewall 115
135 First margin portion of the surrounding sidewall 115
140 Second margin portion of the surrounding sidewall 115
145 Inner surface portion of the surrounding sidewall 115
150 Outer surface portion of the surrounding sidewall 115
155 Attachment of inner surface portion 145 at the first 125 and second 130 end portions
160 Primary interior of the surrounding sidewall 115
165 Substantially rectangular prism shape of the surrounding sidewall 115
170 Outer periphery element of the surrounding sidewall 115
175 Plurality of flexible first chambers
180 Plurality of flexible cylindrical first chambers
185 Interior of cylindrical first chambers 180
190 Adjacency of the flexible first chambers 175 or first cylindrical chambers 180 along the longitudinal axis 120
195 Row positioning of the flexible first chambers 175 or the first cylindrical chambers 180 along the longitudinal axis 120
200 Plurality of first internal axial dividers
205 Multitude of separate first regions
210 Plurality of flexible second chambers
215 Plurality of flexible cylindrical second chambers
220 Interior of cylindrical second chambers 215
225 Plurality of second internal axial dividers
230 Multitude of separate second regions
235 Adjacency of the flexible second chambers 210 or cylindrical second chambers 215 along the longitudinal axis 120
240 Row positioning of the flexible second chambers 210 or cylindrical second chambers 215 along the longitudinal axis 120
245 Interstice position of the first 175 and second 210 chambers or the first 180 and second 215 cylindrical chambers
250 Circular lattice structure of the first 175 and second 210 chambers or the first 180 and second 215 cylindrical chambers
255 Outer edge of the second chamber 210 or the cylindrical second 215 chamber
260 Midway point of the first chamber 175 or the first 180 cylindrical chamber
265 Positioning of the outer edge 255 over the midway point 260
270 Offset positional relationship between the first 175 and second 210 chambers or the first 180 and second 215 cylindrical chambers along the longitudinal axis 120
275 Ancillary axis
280 Perpendicular position of ancillary axis 275 to the longitudinal axis 120
285 Plurality of open spaces without the particulate items 300
290 Equilateral triangular shape with inwardly arcuate sides for the open spaces 285
295 Fluid communication as between first 175 and second 210 chambers or the multitude of first 205 and second 230 regions and the primary interior 160
300 Particulate items
305 Continuous strata of particulate items 300 as formed within the primary interior 160 as between the first 125 and second 130 end portions and between the first 135 and second 140 margin portions
310 Non-symmetrical outer surface of the particulate items 300
315 Means for removable engagement
320 Engaged operational state of the means for removable engagement 315
325 Disengaged operational state of the means for removable engagement 315
330 Buckles for the means for removable engagement 315
335 Overlap of the first 135 and second 140 margin portions about the article 65 or sportboard 75 around the lengthwise axis 70 or 90 respectively in the engaged operational state 320 of the means for removable engagement 315
340 Aperture disposed therethrough the surrounding sidewall 115
345 Valve disposed in the aperture 340
346 Fluid flow therethrough
350 Open state of valve 345 allowing fluid flow therethrough 346
355 Evacuated state of particulate items 300 and the open spaces 285
360 Greater distance shrinkage between first 135 and second 140 margin portions of the surrounding sidewall 115
365 Lesser distance shrinkage between first 125 and second 130 end portions of the surrounding sidewall 115
370 Compressing the article 65 or sportboard 75 with greater force perpendicular to the lengthwise axis 70 or 90 respectively and on the sportboard 75 upon the outer periphery 100
375 Compressing the article 65 or sportboard 75 with lesser force parallel to the lengthwise axis 70 or 90 respectively
380 Un-evacuated state of particulate items 300 and the open spaces 285
385 Enveloping the article 65 or sportboard 75 with the surrounding sidewall 115

DETAILED DESCRIPTION

Figure 2:
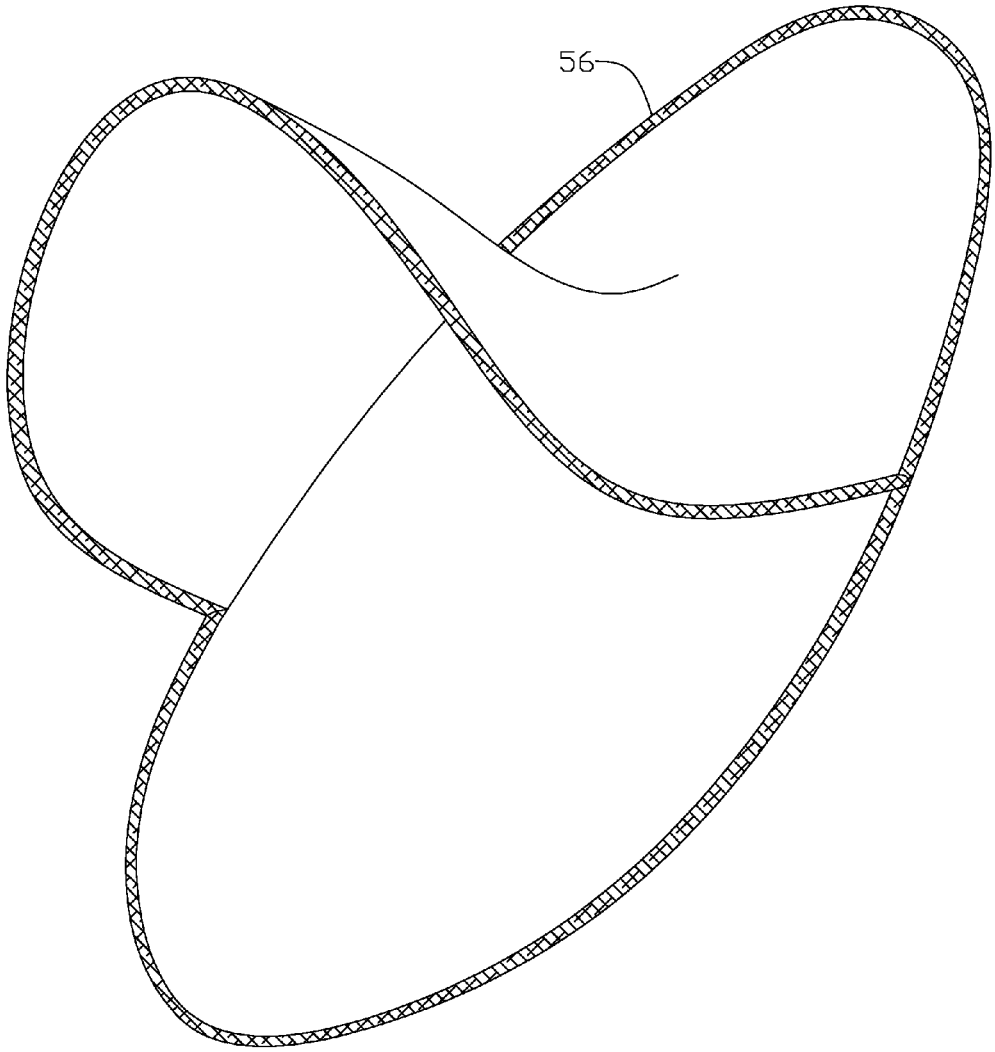
Fig.2 (Prior Art)
FIG. 2 shows a conventional prior art sport board cover, basically being a giant pocket to accommodate the largest sportboards.
Figure 3:
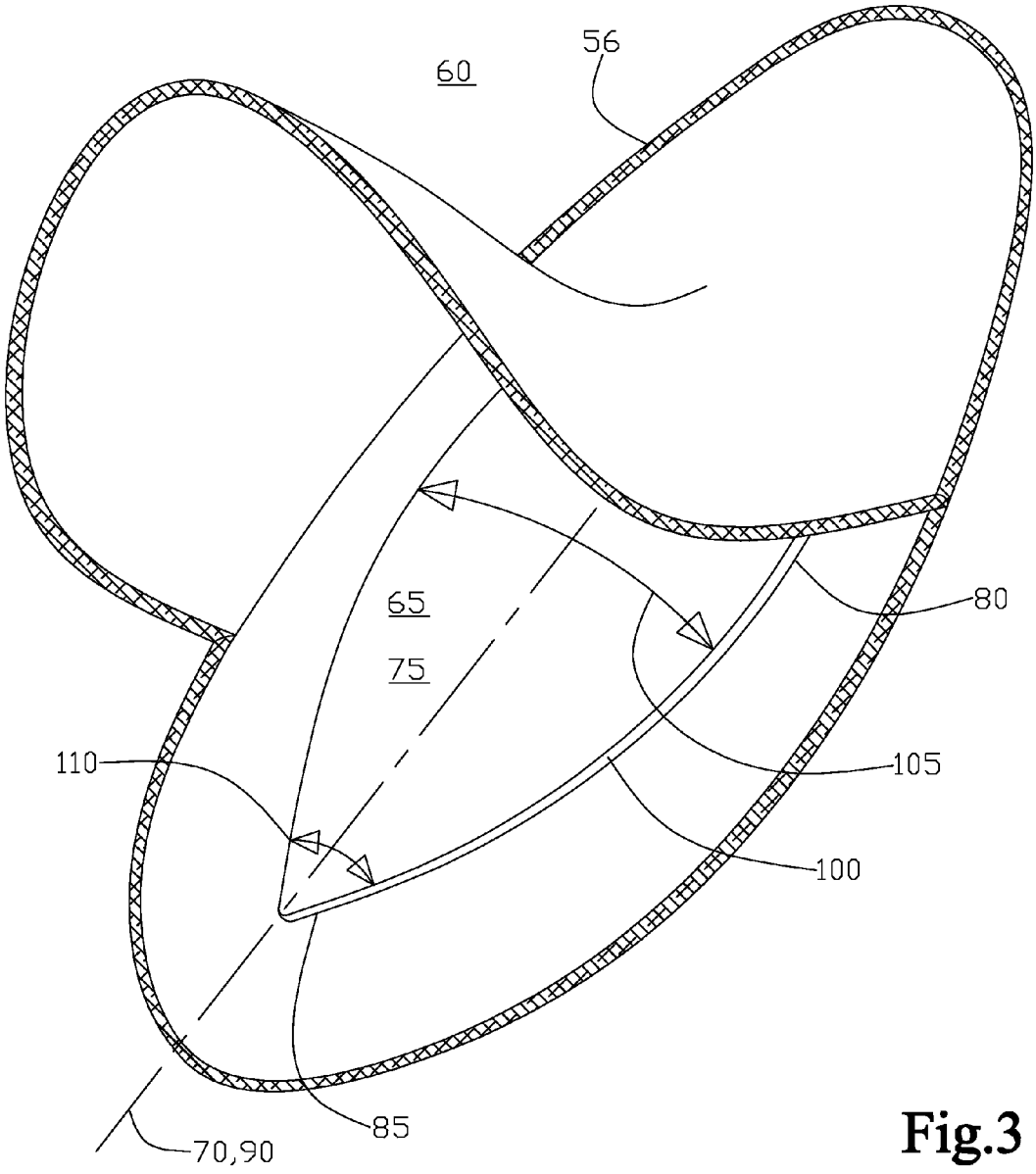
Fig.3 (Prior Art)
FIG. 3 basically shows the combination of FIGS. 1 and 2, with the typical sportboard inserted into the conventional prior art cover, especially showing the excess of space as between the sportboard and the cover interior, which again is done to accommodate all sizes of sportboards with a single cover size, plus to make for easy insertion and removal of the sportboard from the prior art cover.

With initial reference to FIG. 1 shown is a typical article 65 or sportboard 75 with the lengthwise axis 70 and 90 respectively, the central portion 80, the opposing end portions 85, the outer periphery 100, the wider periphery 105 at the central portion 80, and the narrower periphery 110 at the opposing end portions 85. Further, FIG. 2 shows a conventional prior art sport board cover 56, basically being a giant pocket to accommodate the largest sportboards 75. Next, FIG. 3 basically shows the combination of FIGS. 1 and 2, with the typical sportboard 75 inserted into the conventional prior art cover 56, especially showing the excess of space as between the sportboard 75 and the cover 56 interior, which again is done to accommodate all sizes of sportboards 75 with a single cover 56 size to make for easy insertion and removal of the sportboard 75 from the prior art cover 56.

Figure 4:
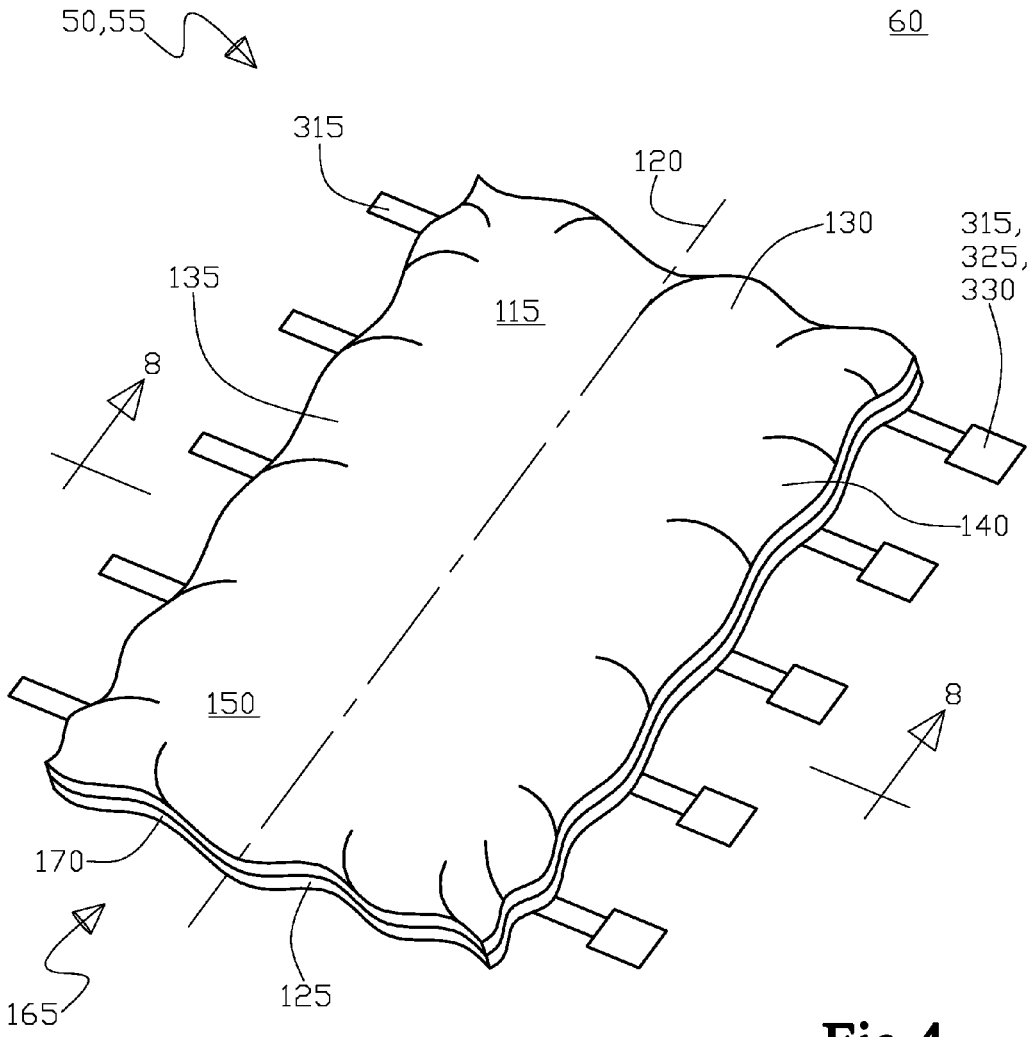
FIG. 4 shows a perspective view of the encasement protective apparatus or more particularly the protective case for the sportboard with the apparatus laid out flat being substantially in the shape of a rectangular prism, with the side facing up that is adjacent to the sportboard, further shown is the longitudinal axis and the means for removable engagement.
Figure 5:
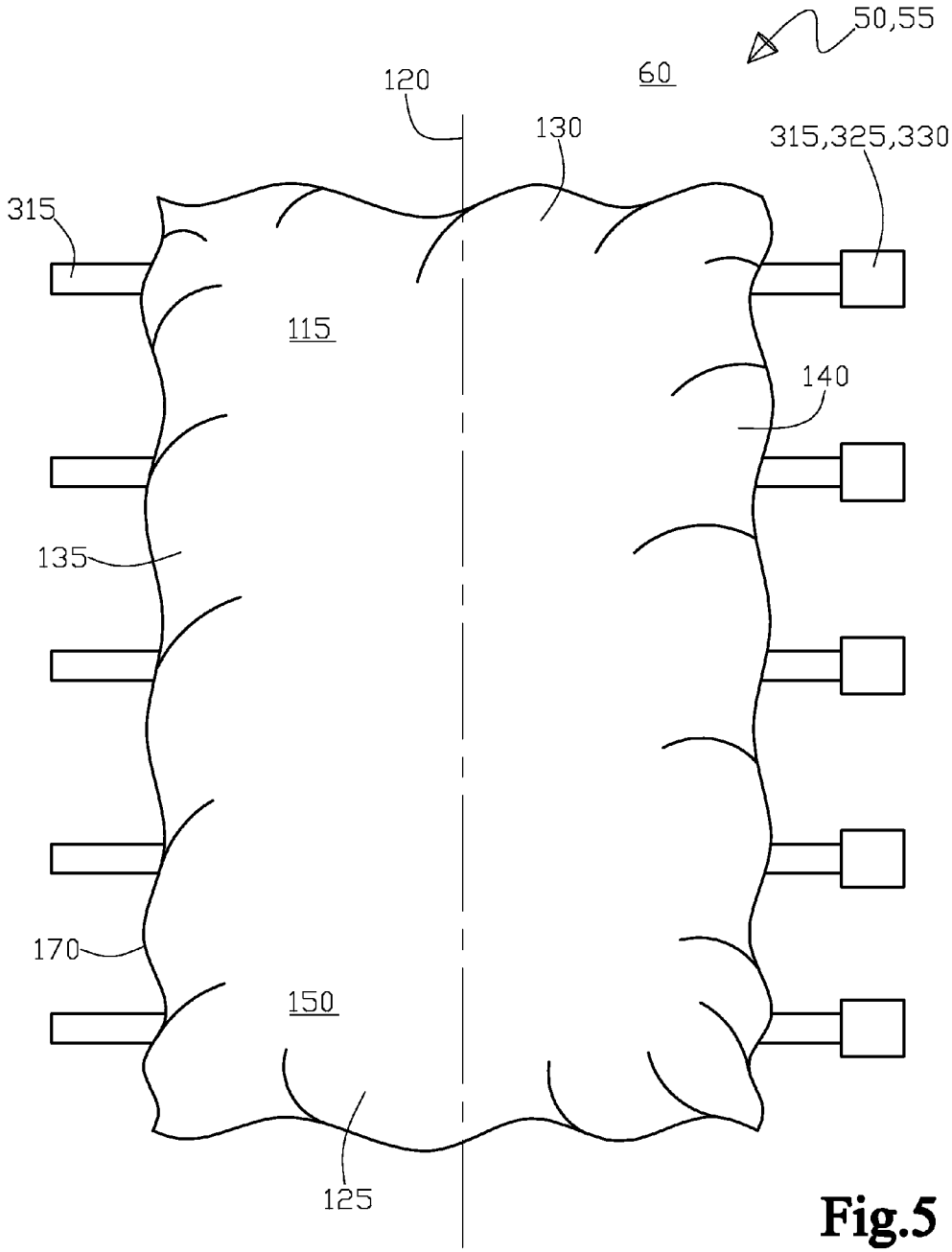
FIG. 5 shows a top view of the encasement protective apparatus or more particularly the protective case for the sportboard with the apparatus laid out flat being substantially in the shape of a rectangular prism, with the side facing up that is adjacent to the sportboard, further shown is the longitudinal axis and the means for removable engagement.

Continuing, in FIG. 4 shown is a perspective view of the encasement protective apparatus 50 or more particularly the protective case 55 for the sportboard 75 with the apparatus 50 laid out flat being substantially in the shape of a rectangular prism 165, with the side facing up that is adjacent to the sportboard 75, further shown is the longitudinal axis 120 and the means 315 for removable engagement. Next, in FIG. 5 shown is a top view of the encasement protective apparatus 50 or more particularly the protective case for the sportboard 55 with the apparatus laid out flat being substantially in the shape of a rectangular prism 165, with the side facing up that is adjacent to the sportboard 75, further shown is the longitudinal axis 120 and the means 315 for removable engagement.

Figure 6:
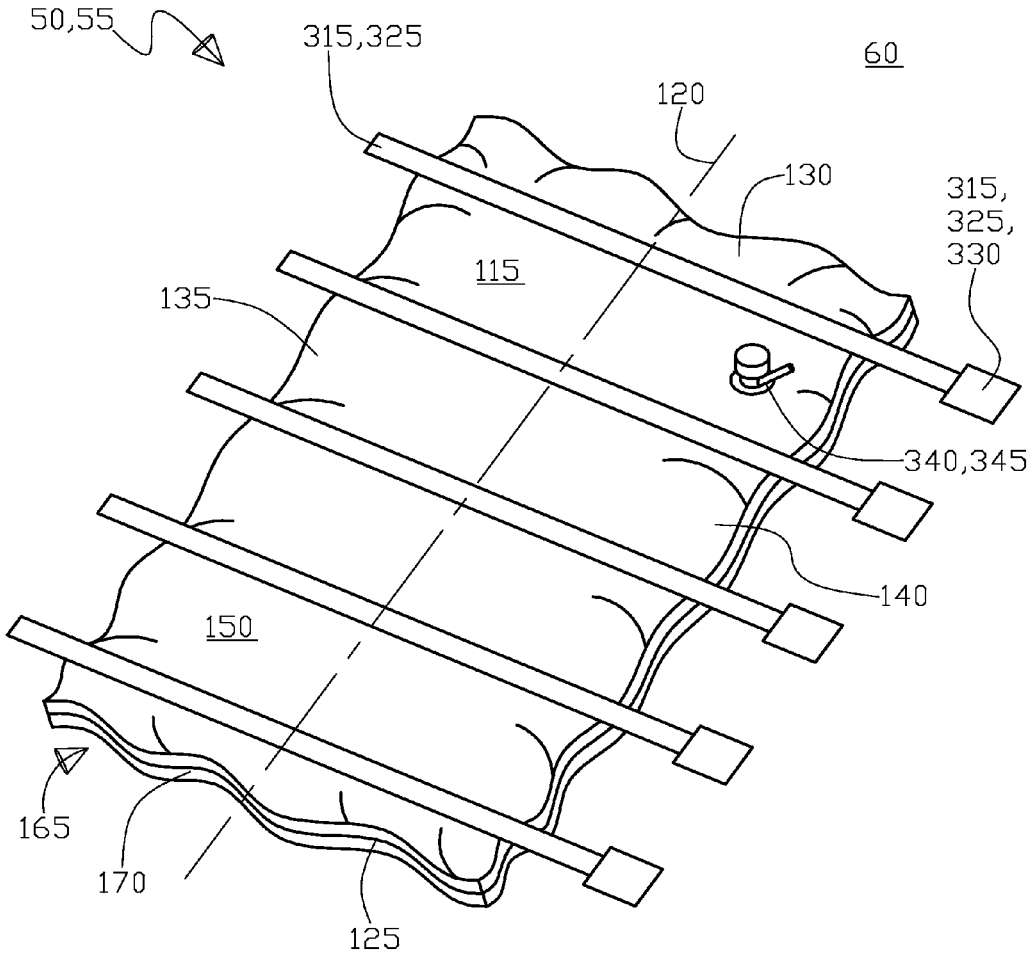
FIG. 6 shows a perspective view of the encasement protective apparatus or more particularly the protective case for the sportboard with the apparatus laid out flat being substantially in the shape of a rectangular prism, with the side facing up that is opposite to the sportboard adjacent side, further shown is the longitudinal axis, the aperture, the valve, and the means for removable engagement.
Figure 7:
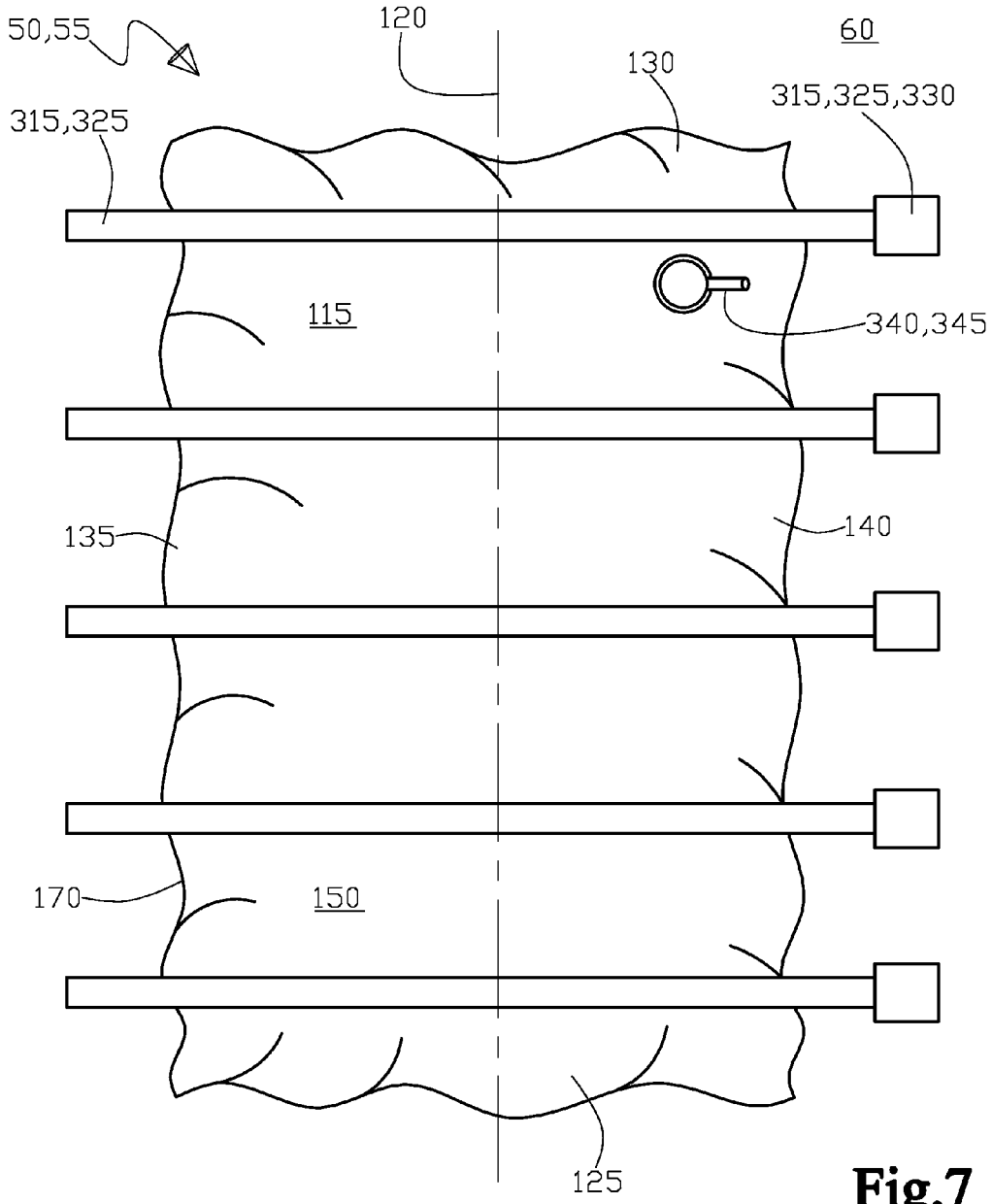
FIG. 7 shows a top view of the encasement protective apparatus or more particularly the protective case for the sportboard with the apparatus laid out flat being substantially in the shape of a rectangular prism, with the side facing up that is opposite to the sportboard adjacent side, further shown is the longitudinal axis, the aperture, the valve, and the means for removable engagement.

Moving to FIG. 6 shown is a perspective view of the encasement protective apparatus 50 or more particularly the protective case 55 for the sportboard 75 with the apparatus laid out flat being substantially in the shape of a rectangular prism 165, with the side facing up that is opposite to the sportboard 75 adjacent side, further shown is the longitudinal axis 120, the aperture 340, valve 345, and the means 315 for removable engagement. Further, FIG. 7 shows a top view of the encasement protective apparatus 50 or more particularly the protective case 55 for the sportboard 75 with the apparatus laid out flat being substantially in the shape of a rectangular prism 165, with the side facing up that is opposite to the sportboard 75 adjacent side, further shown is the longitudinal axis 120, the aperture 340, valve 345, and the means 315 for removable engagement. Next, FIG. 8 shows view 8-8 from FIG. 4 showing the cross section of the primary interior 160 of the surrounding sidewall 115, wherein the plurality of the first 175 and second 210 chambers, particulate items 300, row positioning 195 and 240 respectively, interstice positioning 245, circular lattice structure 250, open spaces 285, and valve 345 are shown.

Figure 8:
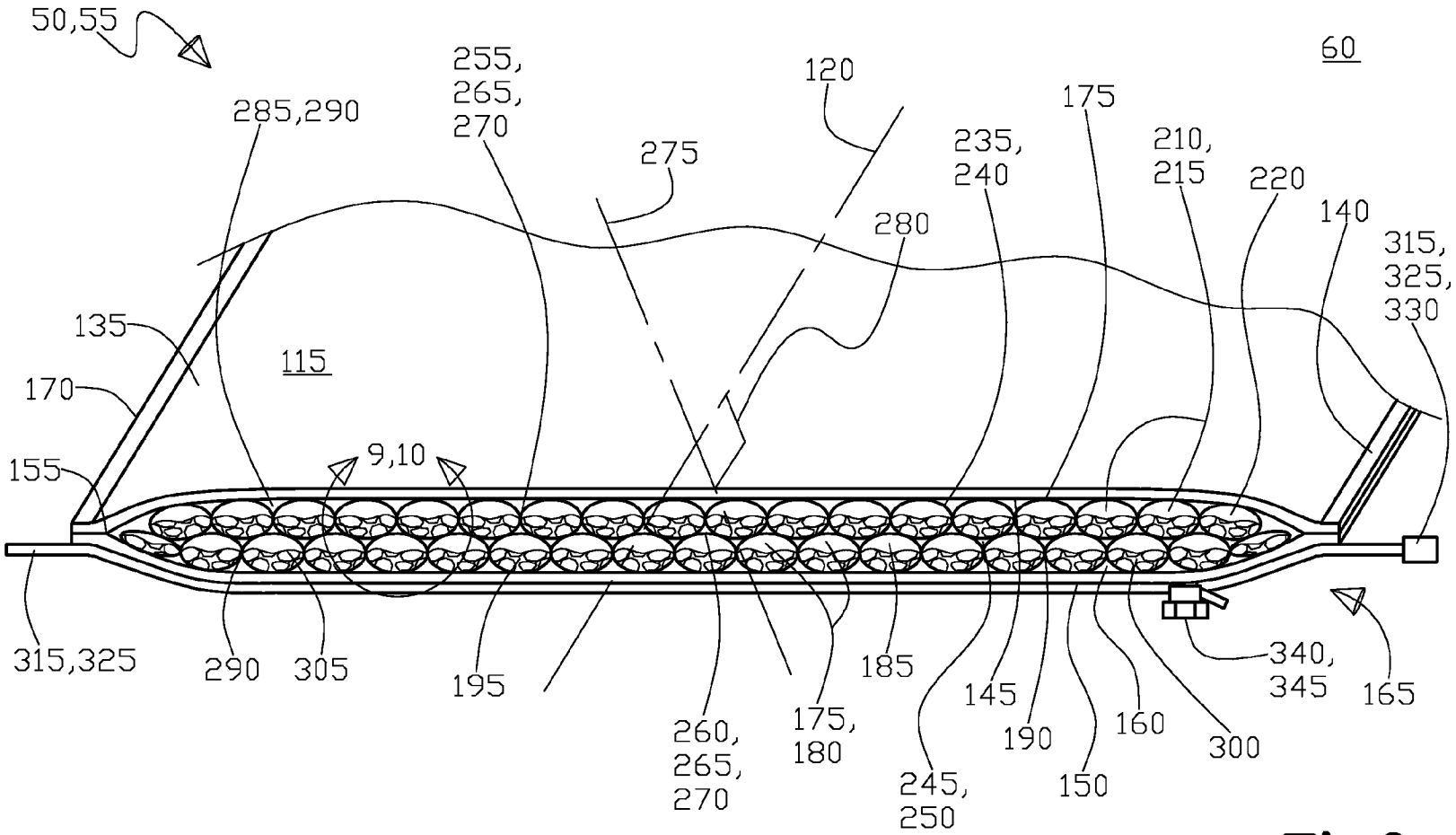
FIG. 8 shows view 8-8 from FIG. 4 showing the cross section of the primary interior of the surrounding sidewall, wherein the plurality of the first and second chambers, particulate items, row positioning, interstice positioning, circular lattice structure, open spaces, and valve are shown.
Figure 9:
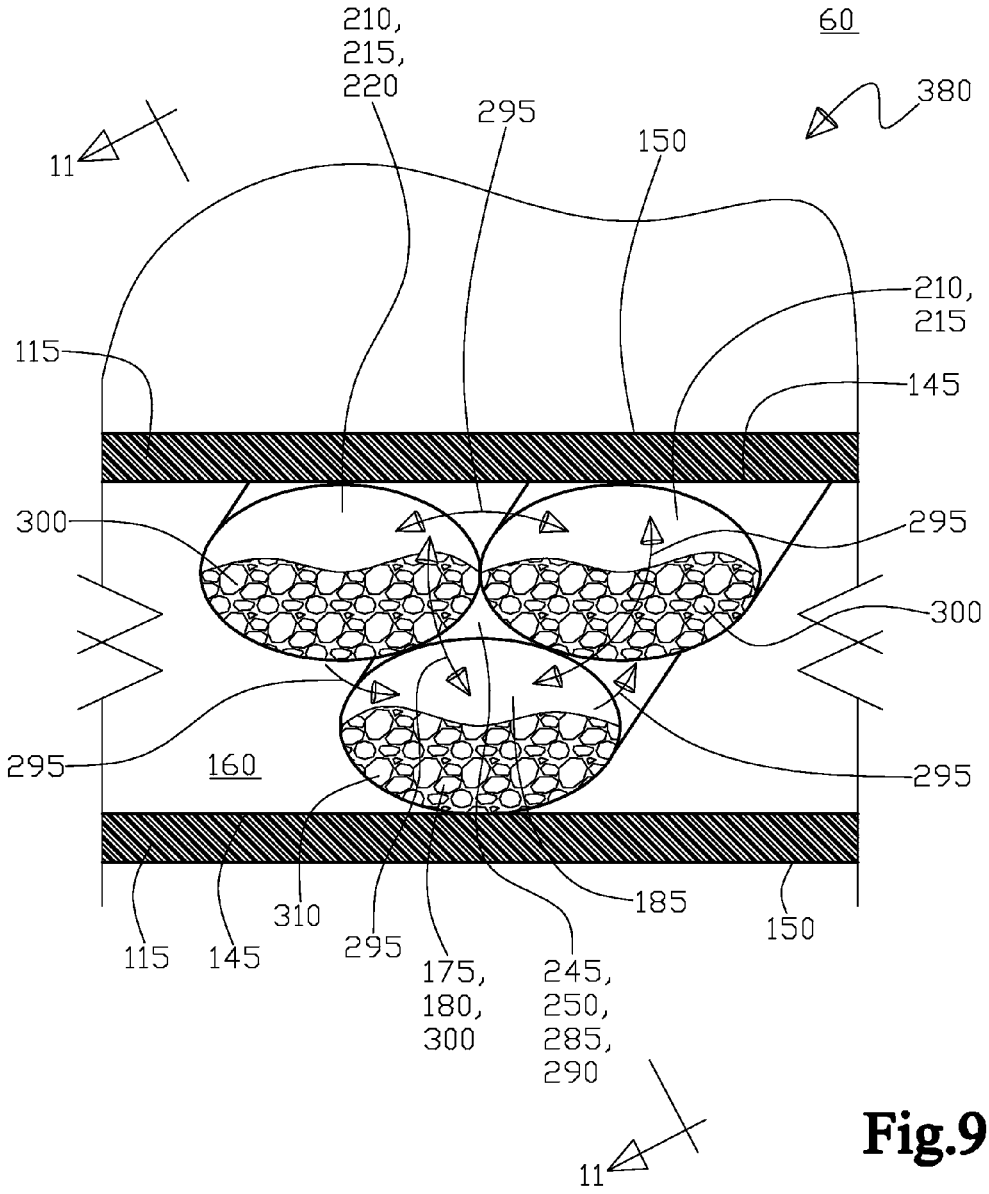
FIG. 9 is a close up view 9-9 of FIG. 8, showing in particular the primary interior of the surrounding sidewall, wherein the plurality of the first and second chambers, particulate items, row positioning, interstice positioning, circular lattice structure, and the open spaces, with the particulate items shown in the un-evacuated state.
Figure 10:
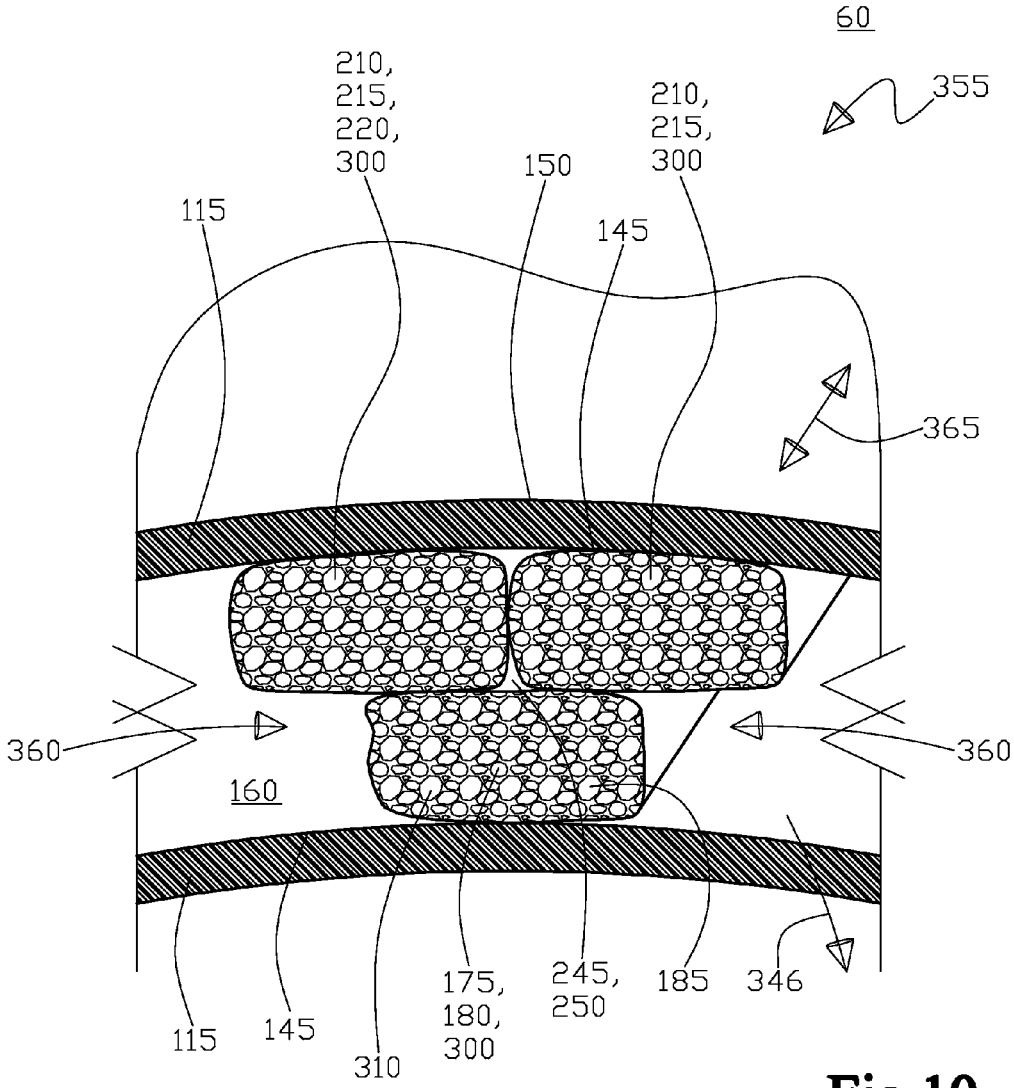
FIG. 10 is a close up view 10-10 of FIG. 8, showing in particular the primary interior of the surrounding sidewall, wherein the plurality of the first and second chambers, particulate items, row positioning, interstice positioning, circular lattice structure, and the open spaces reduced, with the particulate items shown in the evacuated state.

Continuing to FIG. 9 is a close up view 9-9 of FIG. 8, showing in particular the primary interior 160 of the surrounding sidewall 115, wherein the plurality of the first 175 and second 210 chambers, particulate items 300, row positioning 195 and 240 respectively, interstice positioning 245, circular lattice structure 250, and the open spaces 285, with the particulate items 300 shown in the un-evacuated state 380. Next, in FIG. 10 is a close up view 10-10 of FIG. 8, showing in particular the primary interior 160 of the surrounding sidewall 115, wherein the plurality of the first 175 and second 210 chambers, particulate items 300, row positioning 195 and 240 respectively, interstice positioning 245, circular lattice structure 250, and the open spaces 285 reduced, with the particulate items 300 shown in the evacuated state 355.

Figure 11:
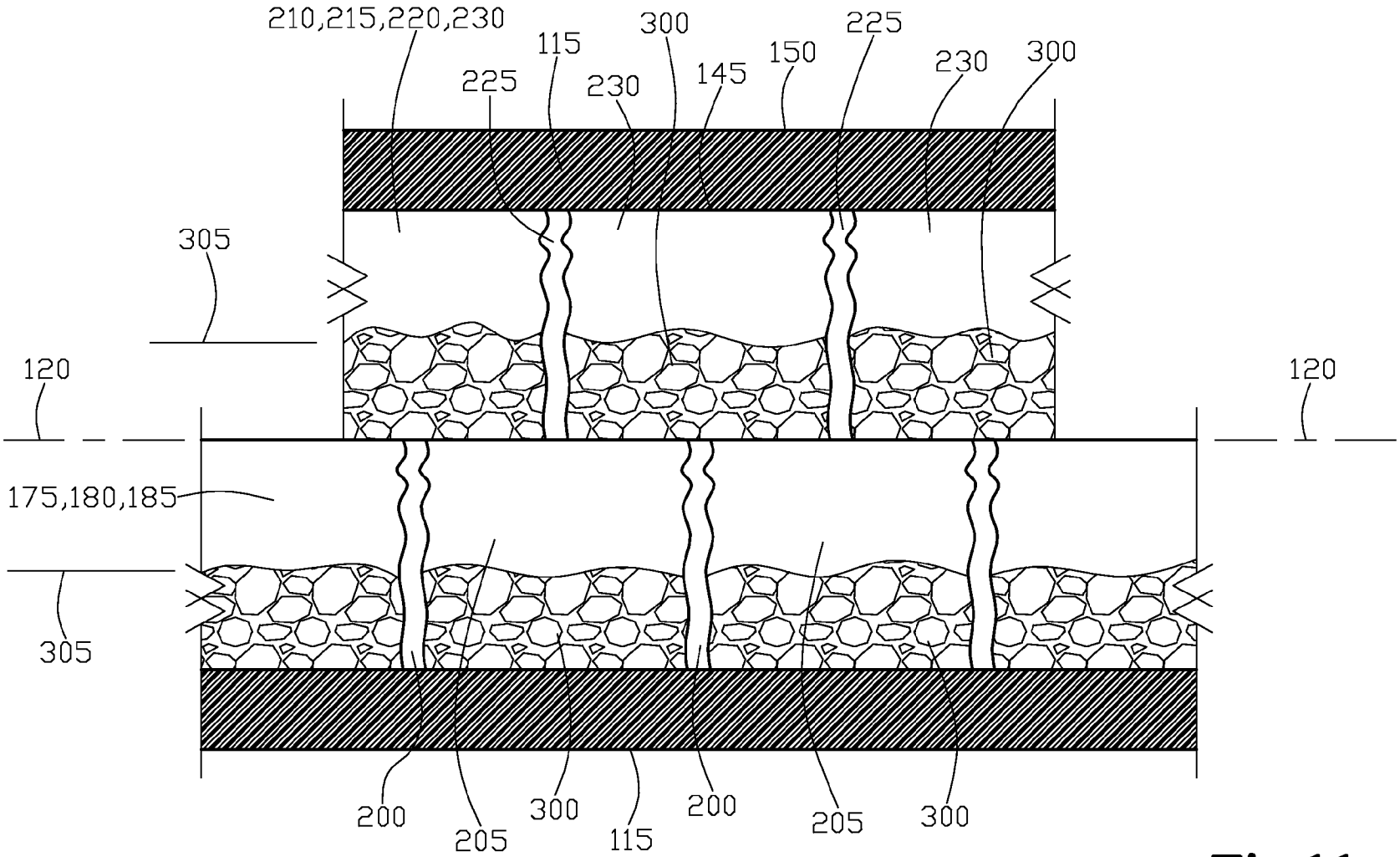
FIG. 11 shows view 11-11 from FIG. 9 being a longitudinal cross section of the surrounding sidewall, the first and second cylindrical chambers, the particulate items, the plurality of first and second internal axial dividers, the multitude of first and second separate regions, all in the un-evacuated state.
Figure 12:
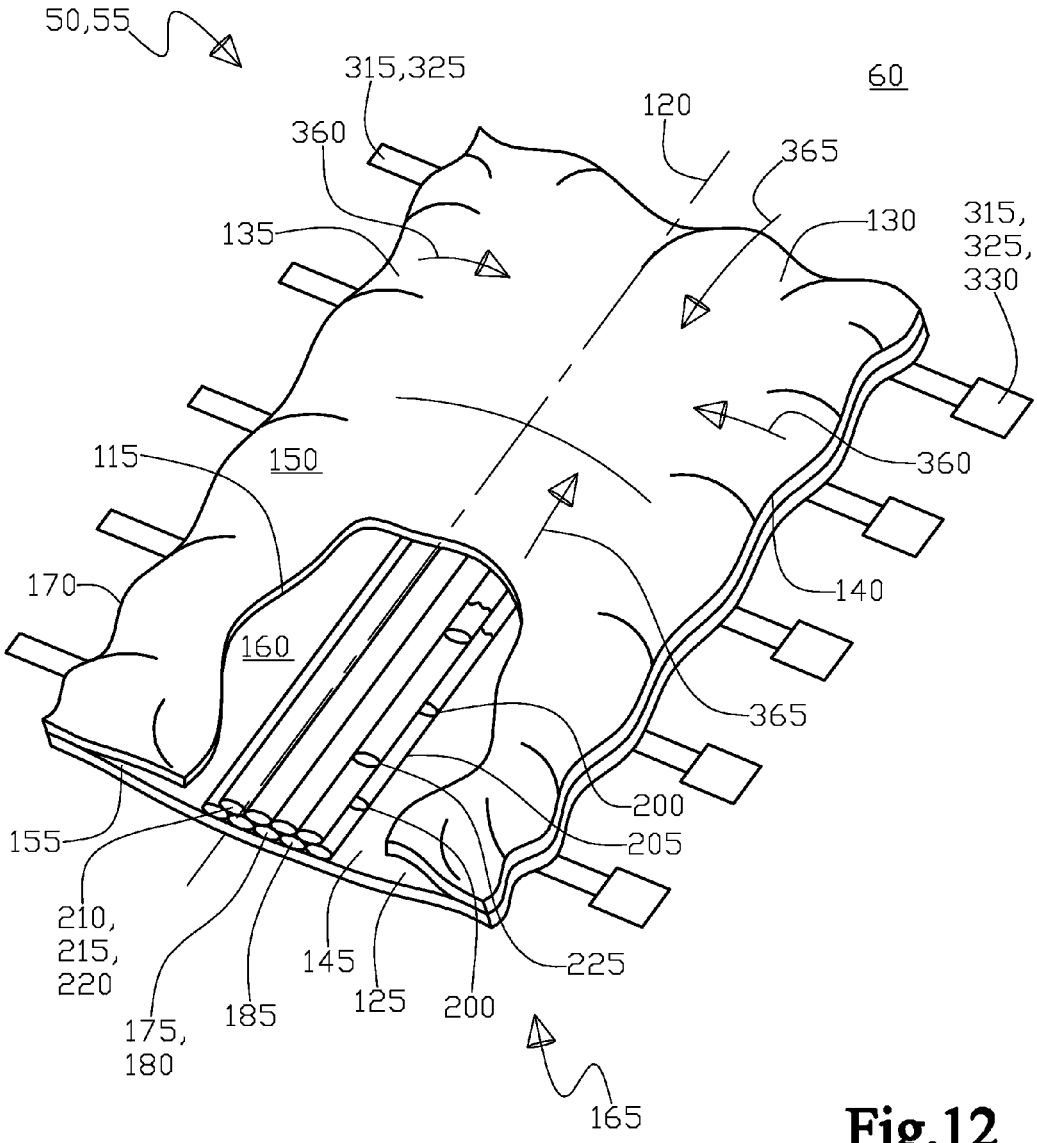
FIG. 12 shows a perspective view of the encasement protective apparatus or more particularly the protective case for the sportboard with the apparatus laid out flat being substantially in the shape of a rectangular prism, with the side facing up that is adjacent to the sportboard, wherein a cross sectional opening is shown for exposing the first and second cylindrical chambers, the plurality of first and second internal axial dividers, the multitude of first and second separate regions, row positioning, interstice positioning, and circular lattice structure all in the un-evacuated state, further shown is the longitudinal axis and the means for removable engagement.

Furthermore, FIG. 11 shows view 11-11 from FIG. 9 being a longitudinal cross section of the surrounding sidewall 115, first 180 and second 215 cylindrical chambers, particulate items 300, the plurality of first 200 and second 225 internal axial dividers, the multitude of first 205 and second 230 separate regions, all in the un-evacuated state 380. Next, FIG. 12 shows a perspective view of the encasement protective apparatus 50 or more particularly the protective case 55 for the sportboard 75 with the apparatus 50 laid out flat being substantially in the shape of a rectangular prism 165, with the side facing up that is adjacent to the sportboard 75, wherein a cross sectional opening is shown for exposing the first 180 and second 215 cylindrical chambers, the plurality of first 200 and 225 second internal axial dividers, the multitude of first 205 and second 230 separate regions, row positioning 195 and 240 respectively, interstice positioning 245, circular lattice structure 250 all in the un-evacuated state 380, further shown is the longitudinal axis 120, and the means 315 for removable engagement.

Figure 13:
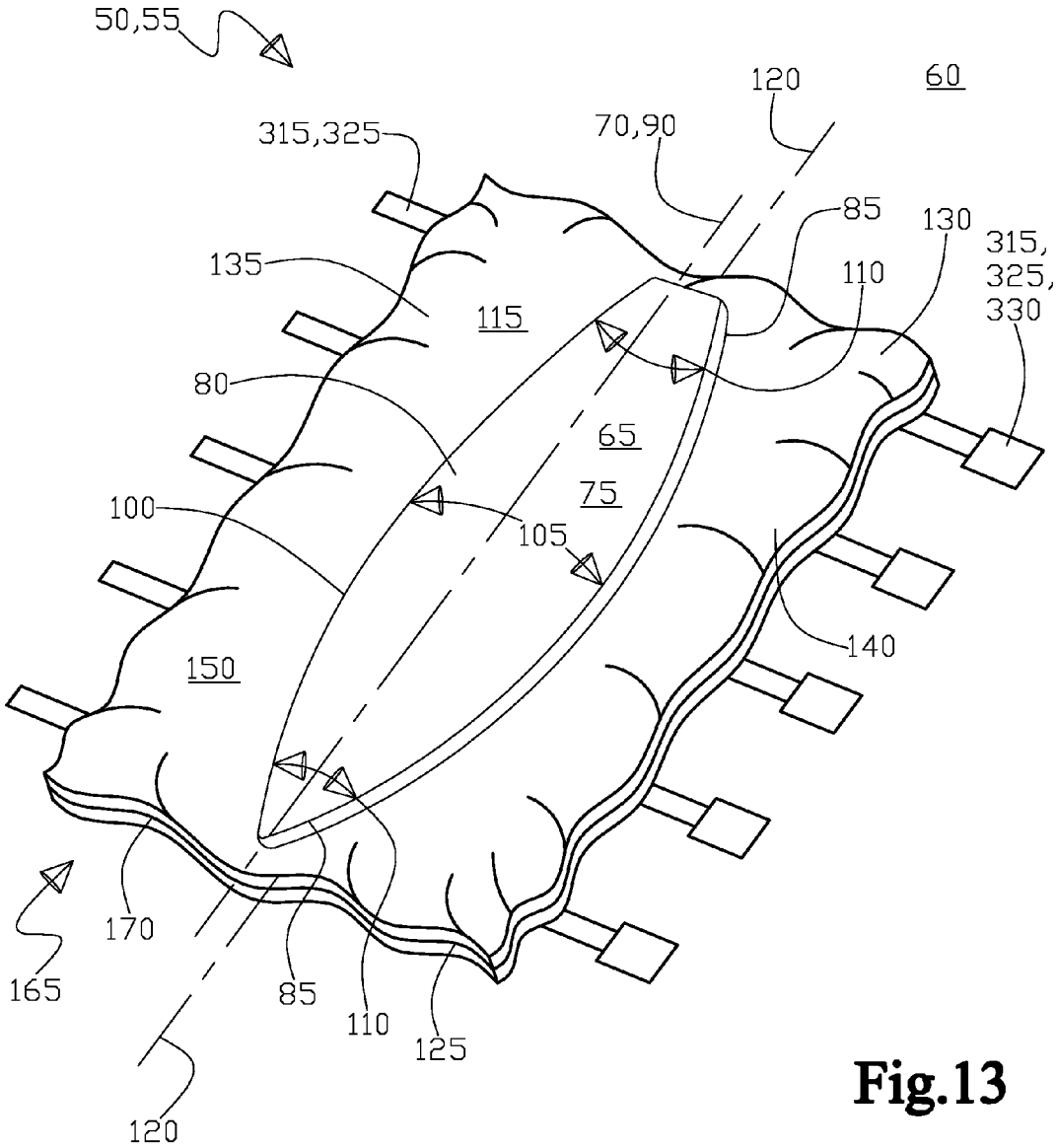
FIG. 13 shows a perspective view of the encasement protective apparatus or more particularly the protective case for the sportboard with the apparatus laid out flat being substantially in the shape of a rectangular prism, with the side facing up that is adjacent to the sportboard with the sportboard shown in place, noting in particular the wider central portion of the sportboard as compared to the narrower opposing end portions of the sportboard on its outer periphery, further shown is the longitudinal axis, and the means for removable engagement.
Figure 14:
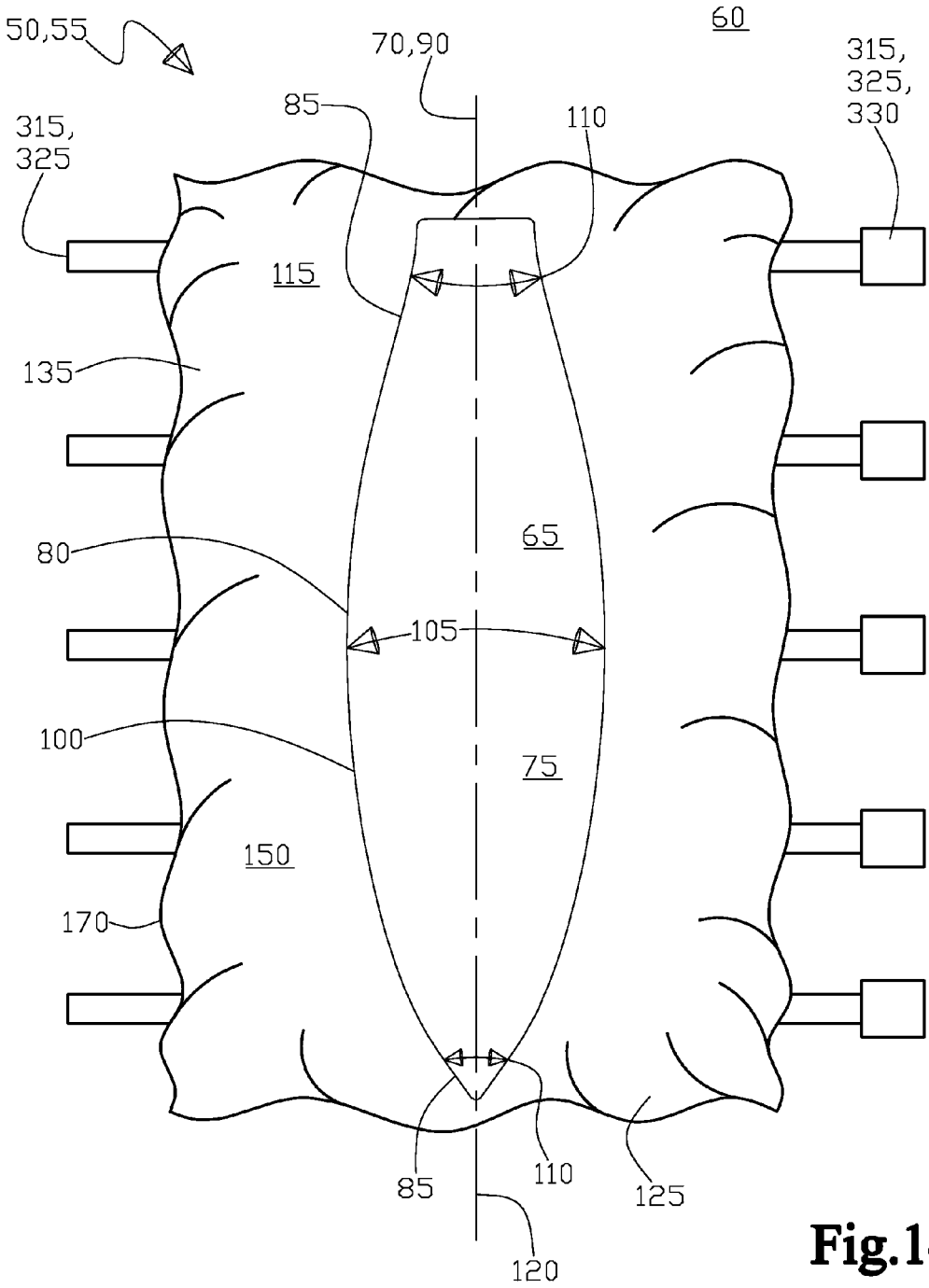
FIG. 14 shows a top view of the encasement protective apparatus or more particularly the protective case for the sportboard, with the apparatus laid out flat being substantially in the shape of a rectangular prism, with the side facing up that is adjacent to the sportboard with the sportboard shown in place, noting in particular the wider central portion of the sportboard as compared to the narrower opposing end portions of the sportboard on its outer periphery, further shown is the longitudinal axis, and the means for removable engagement.

Moving ahead, FIG. 13 shows a perspective view of the encasement protective apparatus 50 or more particularly the protective case 55 for the sportboard 75 with the apparatus 50 laid out flat being substantially in the shape of a rectangular prism 165, with the side facing up that is adjacent to the sportboard 75 with the sportboard 75 shown in place, noting in particular the wider 105 central portion 80 of the sportboard 75 as compared to the narrower 110 opposing end portions 85 of the sportboard 75 on its outer periphery 100, further shown is the longitudinal axis 120 and the means 315 for removable engagement. Next, FIG. 14 shows a top view of the encasement protective apparatus 50 or more particularly the protective case 55 for the sportboard 75 with the apparatus laid out flat being substantially in the shape of a rectangular prism 165, with the side facing up that is adjacent to the sportboard 75 with the sportboard 75 shown in place, noting in particular the wider 105 central portion 80 of the sportboard 75 as compared to the narrower 110 opposing end portions 85 of the sportboard 75 on its outer periphery 100, further shown is the longitudinal axis 120 and the means 315 for removable engagement.

Figure 15:
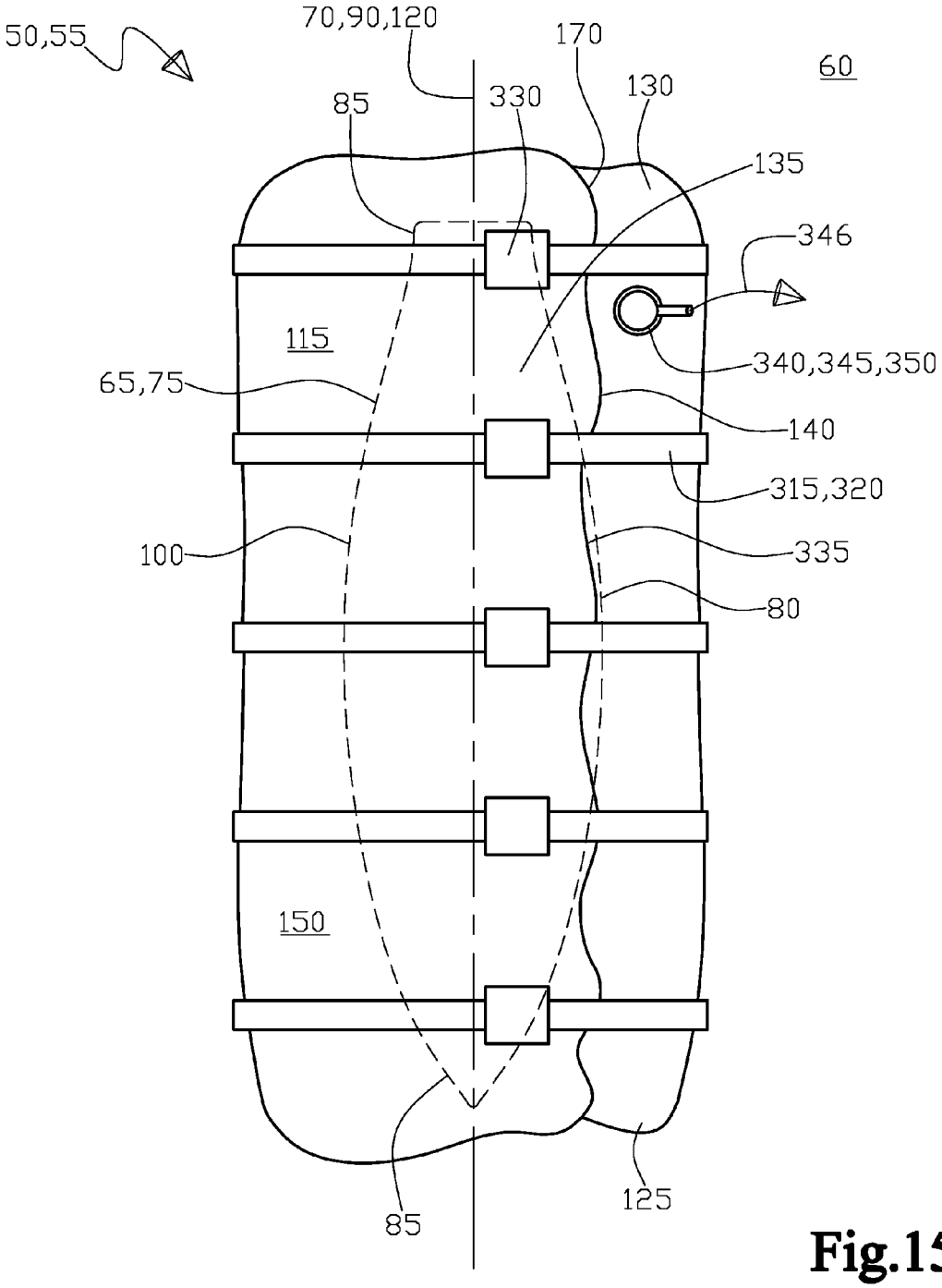
FIG. 15 shows a top view of the encasement protective apparatus or more particularly the protective case for the sportboard with the apparatus shown in enveloping the sportboard, with the sportboard shown in place via dashed lines, noting in particular the wider central portion of the sportboard as compared to the narrower opposing end portions of the sportboard on its outer periphery, further shown is the longitudinal axis and the means for removable engagement in the engaged operational state.
Figure 16:
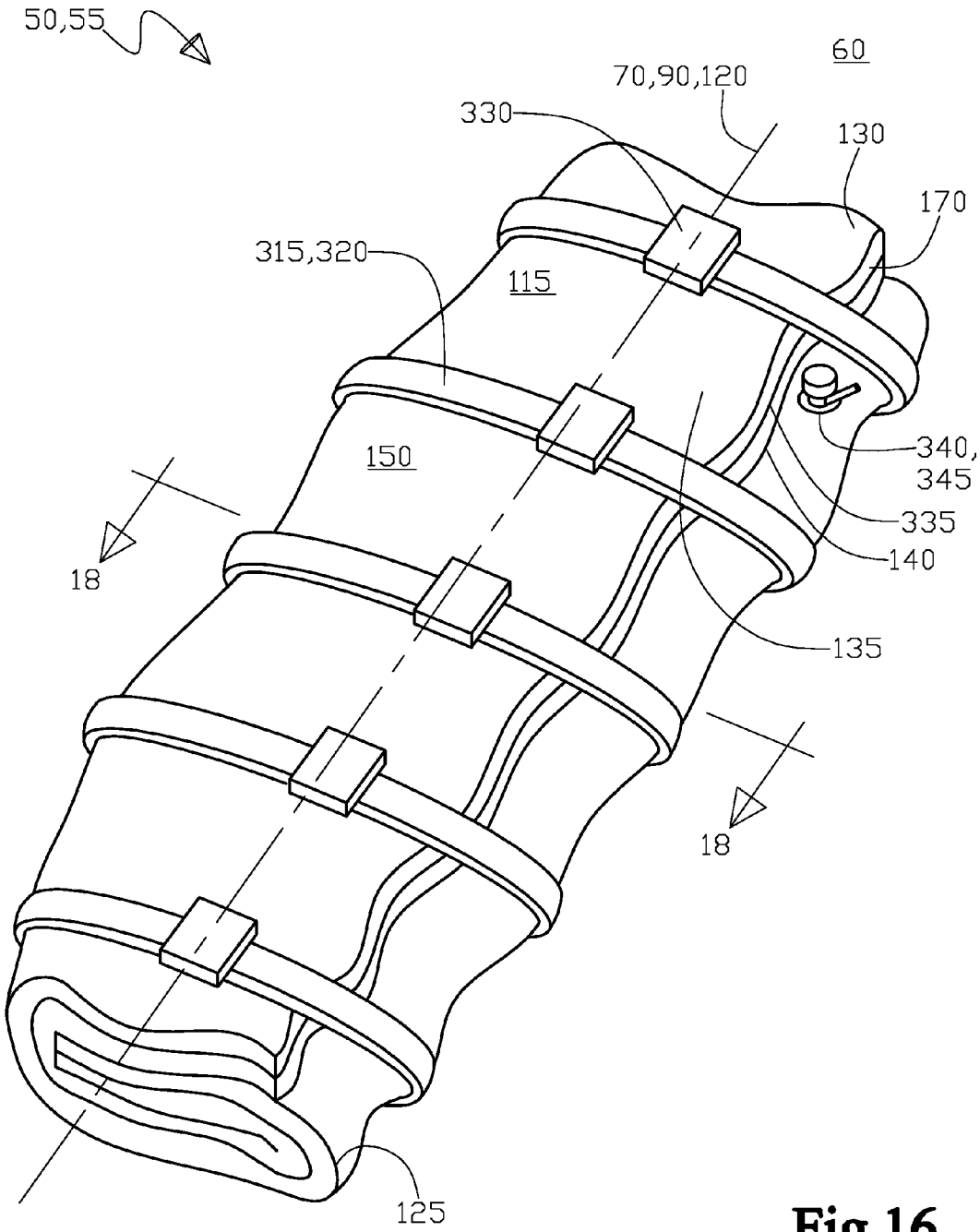
FIG. 16 shows a perspective view of the encasement protective apparatus or more particularly the protective case for the sportboard with the apparatus shown in enveloping the sportboard, further shown is the longitudinal axis, and the means for removable engagement in the engaged operational state.

Continuing, FIG. 15 shows a top view of the encasement protective apparatus 50 or more particularly the protective case 55 for the sportboard 75 with the apparatus shown in enveloping 385 the sportboard 75, with the sportboard 75 shown in place via dashed lines, noting in particular the wider 105 central portion 80 of the sportboard 75 as compared to the narrower 110 opposing end portions 85 of the sportboard 75 on its outer periphery 100, further shown is the longitudinal axis 120 and the means 315 for removable engagement in the engaged operational state. Further, FIG. 16 shows a perspective view of the encasement protective apparatus 50 or more particularly the protective case 55 for the sportboard 75 with the apparatus 50 shown in enveloping 385 the sportboard 75, further shown is the longitudinal axis 120 and the means 315 for removable engagement in the engaged operational state 320.

Figure 17:
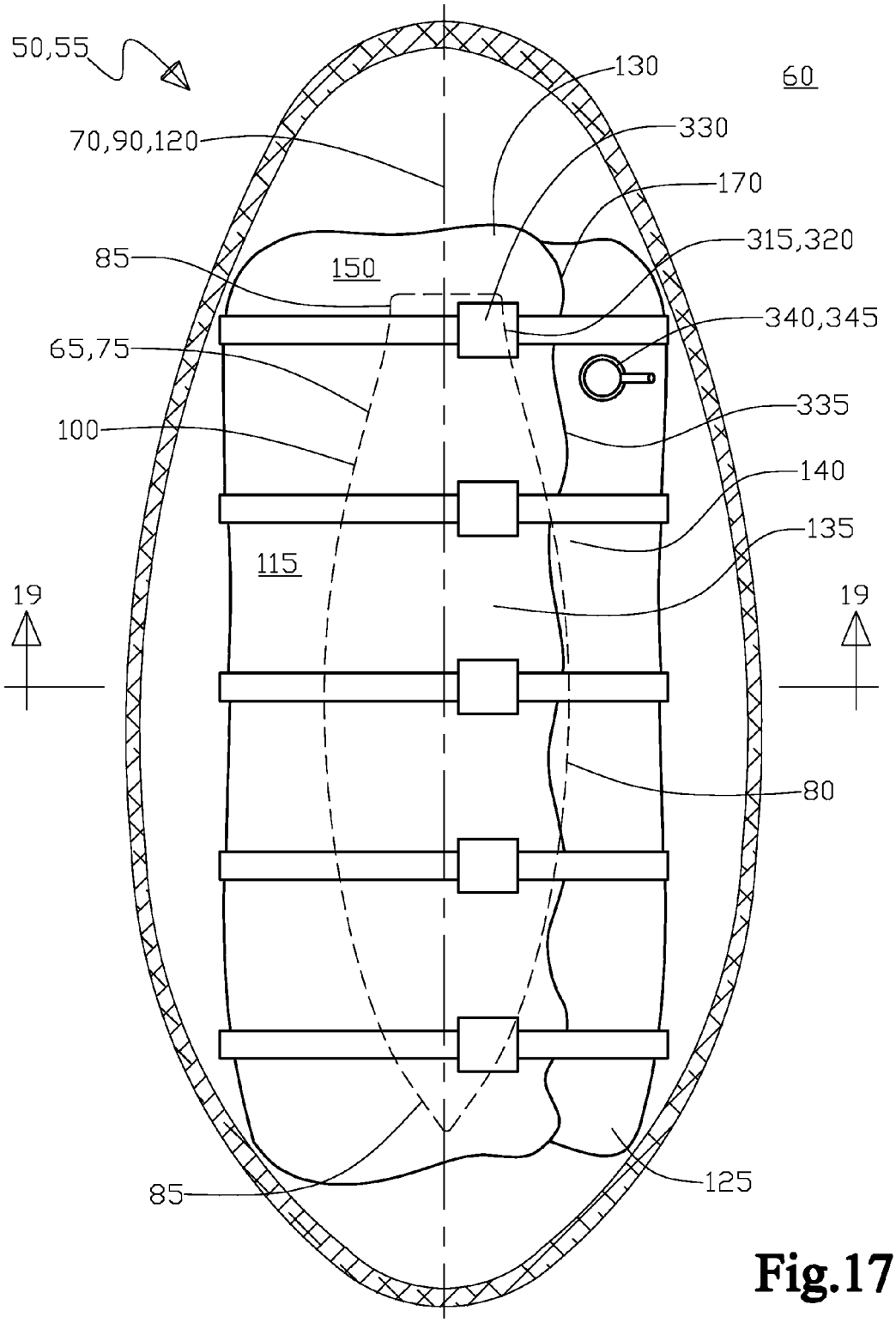
FIG. 17 shows a top view of the encasement protective apparatus or more particularly the protective case for the sportboard with the apparatus shown in enveloping the sportboard, with the sportboard shown in place via dashed lines, noting in particular the wider central portion of the sportboard as compared to the narrower opposing end portions of the sportboard on its outer periphery, further shown is the longitudinal axis and the means for removable engagement in the engaged operational state, wherein the apparatus is disposed within a conventional prior art sportboard cover.
Figure 18:
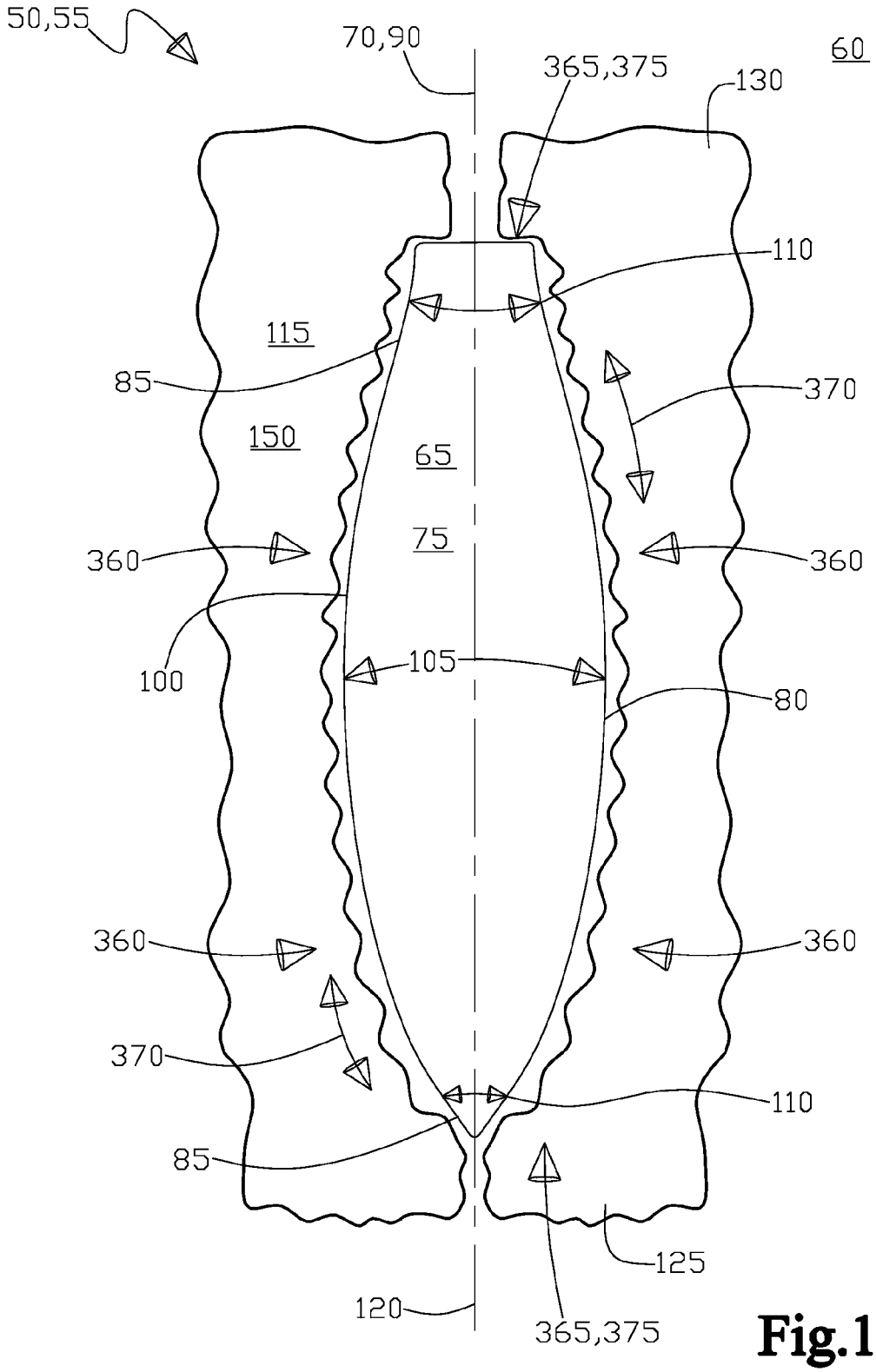
FIG. 18 shows cross sectional view 18-18 from FIG. 16, showing in particular the top view of the encasement protective apparatus or more particularly the protective case for the sportboard with the apparatus shown in enveloping the sportboard, with the apparatus in the evacuated state, wherein in particular the sportboard shown is being compressed on its outer periphery, noting in particular the wider central portion of the sportboard as compared to the narrower opposing end portions of the sportboard on its outer periphery, wherein the compression especially as against the narrower opposing end portions that keep the sportboard securely in place, especially axially along the longitudinal axis.

Moving on to FIG. 17 shows a top view of the encasement protective apparatus 50 or more particularly the protective case 55 for the sportboard 75 with the apparatus 50 shown in enveloping 385 the sportboard 75, with the sportboard 75 shown in place via dashed lines, noting in particular the wider 105 central portion 80 of the sportboard 75 as compared to the narrower 110 opposing end portions 85 of the sportboard 75 on its outer periphery 100, further shown is the longitudinal axis 120 and the means 315 for removable engagement in the engaged operational state 320, wherein the apparatus 50 or 55 is disposed within a conventional prior art sportboard cover 56. Yet further, FIG. 18 shows cross sectional view 18-18 from FIG. 16, showing in particular top view of the encasement protective apparatus 50 or more particularly the protective case 55 for the sportboard 75 with the apparatus 50 or 55 shown in enveloping 385 the sportboard 75, with the apparatus 50 or 55 in the evacuated state 355, wherein in particular the sportboard 75 shown is being compressed 370 on its outer periphery 100, noting in particular the wider 105 central portion 80 of the sportboard 75 as compared to the narrower 110 opposing end portions 85 of the sportboard 75 on its outer periphery 100, wherein the compression 370 especially as against the narrower 110 opposing end portions 85 that keep the sportboard 75 securely in place, especially axially along the longitudinal axis 120.

Figure 19:
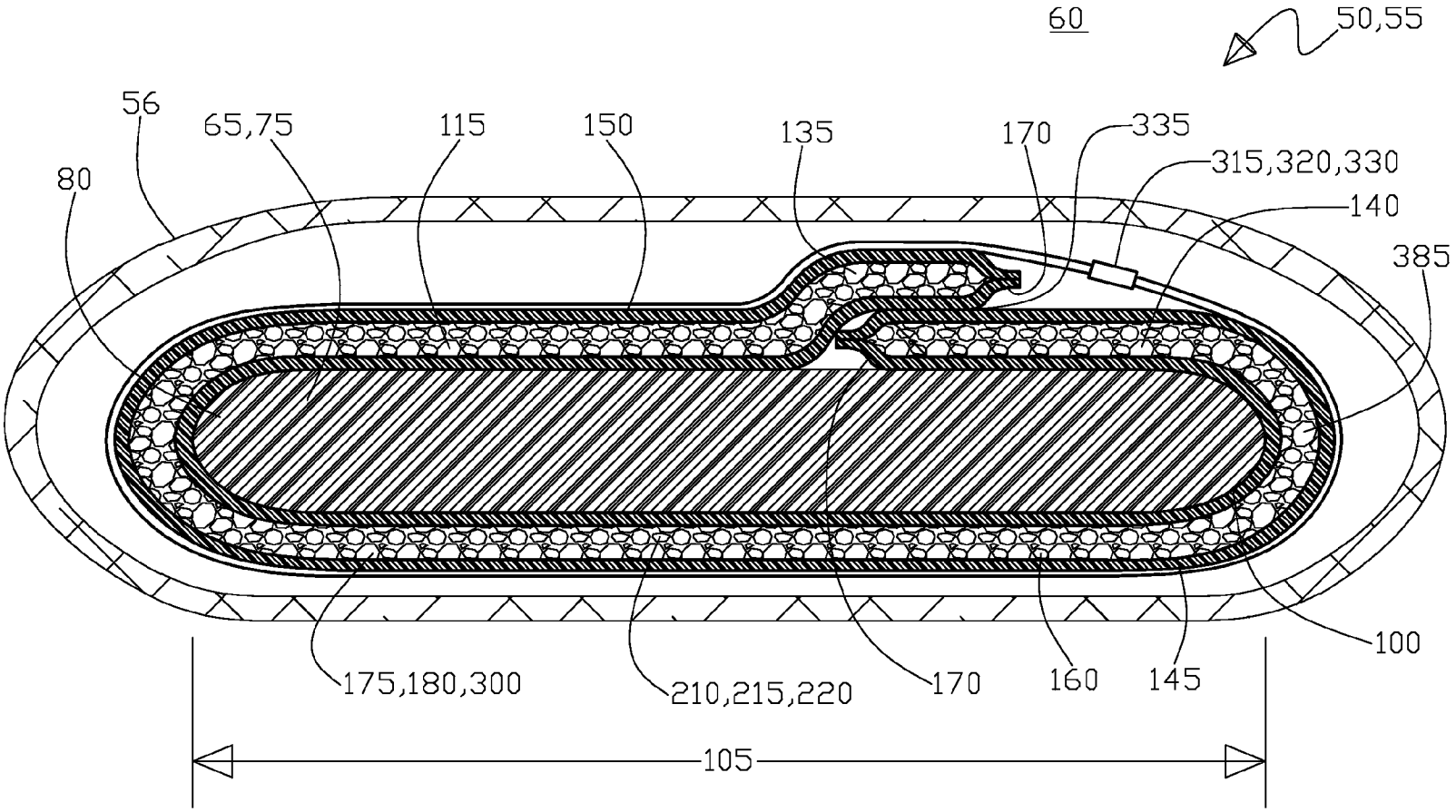
FIG. 19 shows cross section 19-19 from FIG. 17 of the encasement protective apparatus or more particularly the protective case for the sportboard with the apparatus shown in enveloping the sportboard with the overlap of the first and second margin portions, the sportboard is shown in place via a central wider portion cross section, and the means for removable engagement in the engaged operational state, wherein the apparatus is disposed within a conventional prior art sportboard cover.

Continuing, FIG. 19 shows cross section 19-19 from FIG. 17 of the encasement protective apparatus 50 or more particularly the protective case 55 for the sportboard 75 with the apparatus shown in enveloping 385 the sportboard 75 with the overlap 335 of the first 135 and second 140 margin portions, with the sportboard 75 as shown in place via a central 80 wider 105 portion cross section, and the means 315 for removable engagement in the engaged operational state 320, wherein the apparatus 50 or 55 is disposed within a conventional prior art sportboard cover 56.

Looking at FIGS. 4 through 19, the encasement protective apparatus 50 for enveloping 385 an article 65 in disclosed, wherein the article 65 has a lengthwise axis 70, with the apparatus including the flexible surrounding sidewall 115 that is about a longitudinal axis 120, wherein the surrounding sidewall 115 has a first end portion 125 and an opposing second end portion 130, wherein the longitudinal axis 120 is spanning therebetween. The surrounding sidewall 115 also having a first margin portion 135 and an opposing second margin portion 140, wherein the first 135 and second 140 margin portions are substantially parallel to said longitudinal axis 120. The surrounding sidewall 115 also having an outer surface portion 150 and an inner surface portion 145, see FIG. 8, wherein the inner surface portion 145 is attached 155 at the first 125 and second 130 end portions, as best shown in FIGS. 8 and 12. Note that the attachment 155 could be at just the first 125 and second 130 end portions or additionally at the first 135 and second 140 margin portions also depending upon how many pieces that the surrounding sidewall 115 is constructed of. Thus the inner surface portion 145 defines a primary interior 160 that is substantially fluid tight, wherein the surrounding sidewall 115 generally forms a substantially rectangular prism shape 165 with an outer periphery element 170 defined by the first 125 and second 130 end portions and the first 135 and second 140 margins, see FIGS. 4 and 6. Note that for both the protective apparatus 50 and for the protective case 55, all of the descriptions for the common elements apply equally to both the protective apparatus 50 and for the protective case 55. The surrounding sidewall 115 is preferably constructed of a thermoplastic polyurethane (TPU) material, wherein the attachment 155 is preferably via high-frequency material welding or an equivalent.

Continuing, for the protective apparatus 50, also included is the plurality of flexible first chambers 175 disposed within the primary interior 160, wherein the first chambers 175 are adjacent 190 to one another and positioned in rows 195 along the longitudinal axis 120, as best shown in FIG. 8. Further included for the protective apparatus 50 is the plurality of flexible second chambers 210 disposed within the primary interior 160, wherein the second chambers 210 are adjacent 235 to one another and positioned in rows 240 along the longitudinal axis 120, wherein the rows 195 and 240 respectively of the first 175 and second 210 chambers are intersticed 245 in positional orientation 265 to one another in position such that an outer edge 255 of the second chamber 210 lies midway 260 over a first chamber 175 width, resulting that an ancillary axis 275 positioned perpendicular 280 to the longitudinal axis 120 would intersect at least one of the first 175 or second 210 chambers at any position within the primary interior 160, see FIG. 8.

Next, included in the protective apparatus 50 is the plurality of particulate items 300 loosely disposed within each of the first 175 and second 210 chambers, as best shown in FIGS. 8 through 11. Also, included in the protective apparatus 50 is the means 315 for removable engagement positioned adjacent to a part of the outer periphery element 170, see FIGS. 4 through 8 and FIGS. 12 through 17. Wherein operationally the means 315 of removable engagement facilitates part of periphery element 170 to be removably engaged to itself allowing the surrounding sidewall 115 to completely envelope 385 the article 65 about the lengthwise axis 70 in an engaged operational state 320 to further facilitate the overlap 335 of the first 135 and second 140 margin portions, see FIGS. 16 through 19. Thus, the longitudinal axis 120 and the lengthwise axis 70 are substantially parallel to one another in the engaged operational state 320, wherein disengagement of the means 315 for removable engagement releases the article 65 from being completely enveloped 385 by the surrounding sidewall 115 in a disengaged operational state 325. As a refinement on the encasement protective apparatus 50, wherein each of the first 175 and second 210 chambers are segmented such that the particulate items 300 may not communicate as between each of the first 175 and second 210 chambers nor into the primary interior 160, as best shown in FIGS. 8 through 11. Further, the particulate items 300 are preferably constructed of a compressible type material or equivalent to have a cushioning effect, in addition the particulate items 300 can preferably have a non-symmetric 310 outer surface to better facilitate higher friction as between the individual particulate items 300 when in the evacuated state 355, as best shown in FIGS. 9 and 10. The particulate items 300 are preferably constructed of Polystyrene beads that are sized at 5 mm in diameter, or an equivalent.

Looking at FIG. 8 in particular, for the encasement protective apparatus 50 the first 175 and second 210 chambers that are in contact with one another along the longitudinal axis 120 and the first 175 chambers are offset 270 in relation to the second 210 chambers such that a continuous strata 305 of particulate items 300 are formed within the primary interior 160 as between the first 125 and second 130 end portions and as between the first 135 and second 140 margin portions, also see FIG. 11, wherein the continuous strata 305 helps keep the particulate matter 300 more evenly distributed within the primary interior 160 irrespective of the positional attitude of the surrounding sidewall 115.

As a further modification to the encasement protective apparatus 50 each of the first 175 and second 210 chambers and the primary interior 160 are all in fluid communication 295 with one another and are also substantially sealed as against an external environment 60 via the surrounding sidewall 115, see FIGS. 9 and 10. The result is that the first 175 and second 210 chambers and the primary interior 160 can have a portion of a fluid evacuated 346 from a single aperture 340 disposed therethrough the surrounding sidewall 115 into the external environment 60, see FIGS. 10 and 15. Resulting in that operationally the particulate items 300 are relatively movable to one another when the first 175 and second 210 chambers are in an un-evacuated state 380, see FIG. 9, and the particulate items 300 are substantially in contact with one another and also substantially immovable relative to one another when the first 175 and second 210 chambers and the primary interior 160 are in an evacuated state 355, forming a rigidified surrounding sidewall 115, see FIG. 10. Wherein the evacuated state 355 is preferably completed as shown in FIG. 15, when the article 65 is enveloped 385 by the surrounding sidewall 115 with overlap 335 and the means 315 for removable engagement in the engaged state 320, thus the surrounding sidewall 115 forming a rigid protective housing around the article 65. The materials of construction for the first 175 and second 210 chambers or the first 180 cylindrical chambers and second 215 cylindrical chambers are preferably a mesh type material that passes a fluid therethrough (such as air), however, not allowing the particulate items 300 to pass through.

Further, for the encasement protective apparatus 50 the single aperture 340 further comprises a valve 345 disposed therein, the valve 345 is selectively able to be placed in an open or closed state, wherein the open state allows fluid flow 346 therethrough the aperture 340 and the closed state substantially prevents fluid flow 346 therethrough the aperture 340, see FIGS. 6 through 8 and FIGS. 15 through 17. The valve 345 is preferably a molded PVC plastic air valve that removably mates to a plastic hand operated evacuating air pump that is eighteen inches long and two inches in diameter, or an equivalent. Also, the means 315 for removable engagement is preferably constructed of a plurality of buckles 330, known as FASTEX type buckles that are attached to the outer surface portion 150 upon the first 135 and second 140 margin portions via flexible straps. Wherein the buckles 330 are positioned to create an overlap 335 of the first 135 and second 140 margin portions about the article 65 around the lengthwise axis 70 in an engaged state 320, see FIGS. 15 through 19, and the buckles 330 releasing the surrounding sidewall 115 from the article 65 in a disengaged state 325, see FIGS. 13 and 14. The means 315 for removable engagement preferably includes 2 inch polypropylene webbing for the strap and a 2 inch Velcro marine hook and loop clasp for the buckle 330.

Further detail of the positioning for the first 175 and second 210 chambers that are in contact with one another 109 and 235 respectively along the longitudinal axis 120 and the first chambers 175 are offset 270 in relation to the second 210 chambers such that the first 175 and second 210 chambers form a circular lattice structure 250 in a cross section perpendicular to the longitudinal axis 120, see FIG. 8, wherein a plurality of open spaces 285 without the particulate items 300, are formed as between the first 175 and second 210 chambers and as between the first 175 and second 210 chambers and the inner surface portion 145, each open space 285 is defined as being an area in a shape of an equilateral triangle 290 with inwardly arcuate sides as forming a portion of the primary interior 160, see FIGS. 8 and 9. Wherein, operationally when the first 175 and second 210 chambers and the primary interior 160 have a portion of the fluid evacuated 346 resulting in the surrounding sidewall 115 becoming rigidified, the equilateral triangle 290 areas will reduce causing the surrounding sidewall 115 to shrink a greater distance 360 as between the first 135 and second 140 margin portions and the surrounding sidewall 115 will shrink a lesser distance 365 as between the first 125 and second 130 end portions, for the purpose of compressing 370 the article 65 with a greater force perpendicular to its lengthwise axis 70 and compressing 375 the article 65 with a lesser force parallel to its lengthwise axis 70, see FIGS. 18 and 19.

Specifically for the protective case for a sportboard 55, or even more particularly a surfboard, the chambers are detailed as follows; included is a plurality of flexible substantially cylindrical first chambers 180 disposed within the primary interior 160, wherein the first chamber cylinders 180 are positioned parallel to the longitudinal axis 120 being adjacent 190 to one another and positioned in a row 195, see FIG. 8, also each first chamber cylinder 180 having a first chamber interior 185 includes a plurality of first internal axial dividers 200 disposed therein the first chamber interior 185. Wherein the first internal axial dividers 200 being spaced apart axially along the longitudinal axis 120 forming a multitude of separate first regions 205 within a single first chamber cylinder 180, as best shown in FIGS. 11 and 12.

Further for the protective case for a sportboard 55, a plurality of flexible substantially cylindrical second chambers 215 is disposed within the primary interior 160, wherein the second chamber cylinders 215 are positioned parallel to the longitudinal axis 120 being adjacent 235 to one another and positioned in a row 240, see FIG. 8, each second chamber cylinder 215 having a second chamber interior 220 that includes a plurality of second internal axial dividers 225 disposed therein the second chamber interior 220, the second internal axial dividers 225 being spaced apart axially along the longitudinal axis 120 forming a multitude of separate second regions 230 within a single second chamber cylinder 215, see FIGS. 11 and 12. In referring to FIG. 8, the rows 195 and 240 respectively of first 180 and second 215 cylindrical chambers are intersticed 245 in positional orientation to one another in position such that an outer edge 255 of a second chamber 215 lies 265 midway 260 over a first chamber 185 width, resulting that an ancillary axis 275 positioned perpendicular 280 to the longitudinal axis 120 would intersect at least one of said first 185 or second 215 chambers at any position within the primary interior 160. Further, a plurality of particulate items 300 is loosely disposed within each of the first 205 and second 230 regions, as best shown in FIG. 11. Also, each of the multitude of first 205 and second 230 regions are segmented such that the particulate items 300 may not communicate as between each of the multitude of first 205 and second 230 regions nor into the primary interior 160, being operational to create a substantially even strata 305 of the particulate items 300 throughout the surrounding sidewall 115 from the first end portion 125 to the second end portion 130 and from the first margin portion 135 to the second margin portion 140, thus to help keep a substantially even distribution of particulate items 300 through the primary interior 160, when the surrounding sidewall 115 is moved in different directions or attitudes, see FIGS. 8 and 11.

In addition, for the protective case for a sportboard 55, wherein the multitude of first 205 and second 230 regions are positioned such that they form a circular lattice 250 structure in a cross section perpendicular to said longitudinal axis 120, wherein a plurality of open spaces 285 without the particulate items 300 are formed as between the first 205 and second 230 regions and as between the first 205 and second 230 regions and the inner surface portion 160, each open space 285 is defined as being an area in a shape of an equilateral triangle 290 with inwardly arcuate sides as forming a portion of the primary interior 160, see FIGS. 8 and 9. Wherein operationally, when the first 205 and second 230 regions and the primary interior 160 have a portion of the fluid evacuated 346 resulting in the surrounding sidewall 115 becoming rigidified in the evacuated state 355, the equilateral triangle 290 areas reducing will cause the surrounding sidewall 115 to shrink a greater distance 360 as between the first 135 and second 140 margin portions and the surrounding sidewall 115 will shrink a lesser distance 365 as between the first 125 and second 130 end portions, for the purpose of compressing the sportboard 75 with a greater force 370 perpendicular to its lengthwise axis 90 being in particular the sportboard outer periphery 100. Thus to fully compressibly 370 envelope the sportboard's 75 narrowing 110 opposing end portions 85 thus fully axially retaining the sportboard 75 within the surrounding sidewall 115 in the rigidified state and the engaged operational state 320 of the means 315 for removable engagement, wherein compressing the sportboard with a lesser force 375 parallel to its lengthwise axis 90, see FIGS. 15 through 19. Wherein the evacuated state 355 is preferably completed as shown in FIG. 15, when the sportboard 75 is enveloped 385 by the surrounding sidewall 115 with overlap 335 and the means 315 for removable engagement in the engaged state 320, thus the surrounding sidewall 115 forming a rigid protective housing around the sportboard 75.

CONCLUSION

Accordingly, the present invention of an encasement protective apparatus 50 and protective case 55 has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. An encasement protective apparatus for a sportboard, the sportboard having a lengthwise axis and an outer periphery that is wider at a central portion and narrower at its opposing end portions along the lengthwise axis, said encasement protective apparatus comprising:

(a) a flexible surrounding sidewall about a longitudinal axis, wherein said surrounding sidewall has a first end portion and an opposing second end portion wherein said longitudinal axis spanning therebetween, said surrounding sidewall also having a first margin portion and an opposing second margin portion, wherein said first and second margin portions are substantially parallel to said longitudinal axis, said surrounding sidewall also having an outer surface portion that is adjacent to an external environment and an inner surface portion, wherein said inner surface portion is attached at said first and second end portions, thereby said inner surface portion defining a primary interior that is substantially fluid tight, wherein said surrounding sidewall generally forms a substantially rectangular prism shape with an outer periphery element defined by said first and second end portions and said first and second margins further a single aperture is disposed therethrough said surrounding sidewall allowing fluid communication from said primary interior into the external environment;

(b) a plurality of flexible first chambers disposed within said primary interior, wherein said first chambers are adjacent to one another and positioned in rows along said longitudinal axis, said plurality of first chambers extend continuously therethrough said primary interior from said first end portion to said second end portion;

(c) a plurality of flexible second chambers disposed within said primary interior, wherein said second chambers are adjacent to one another and positioned in rows along said longitudinal axis, said plurality of second chambers extend continuously therethrough said primary interior from said first end portion to said second end portion, said rows of first and second chambers are intersticed in positional orientation to one another in position such that an outer edge of a second chamber lies midway over a first chamber width, resulting that an ancillary axis positioned perpendicular to said longitudinal axis would intersect at least one of said first or second chambers at any position within said primary interior wherein said first and second chambers are in continuous contact with one another along said longitudinal axis from said first end portion to said second end portion, further said first chambers are offset in relation to said second chambers, such that said first and second chambers form a single circular lattice structure in a cross section perpendicular to said longitudinal axis extending continuously from said first end portion to said second end portion, wherein a plurality of open spaces are defined by a boundary in-between said first and second chambers and said inner surface portion, each said open space results in being an area in a shape of an equilateral triangle with inwardly arcuate sides as forming a portion of said primary interior, said equilateral triangle shapes all extend unobstructed along said longitudinal axis from said first end portion to said second end portion, wherein each of said first and second chambers and said primary interior are all in fluid communication with one another and are also substantially sealed as against the external environment, such that said first and second chambers and said primary interior can have a portion of a fluid evacuated from said single aperture disposed therethrough said surrounding sidewall into the external environment;

(d) a plurality of particulate items loosely disposed within each of said first and second chambers, each of said first and second chambers are segmented such that said particulate items may not communicate as between each of said first and second chambers nor into said primary interior; and (e) a means for removable engagement positioned adjacent to a part of said outer periphery element, wherein operationally said means of removable engagement facilitates said part of periphery element to be removably engaged to itself allowing said surrounding sidewall to completely envelope the sportboard about the lengthwise axis in an engaged operational state, wherein said longitudinal axis and said lengthwise axis are substantially parallel to one another in said engaged operational state, wherein disengagement of said means for removable engagement releases the article from being completely enveloped by said surrounding sidewall in a disengaged operational state, said offset of first and second chambers is such that a continuous strata of said particulate items are formed within said primary interior as between said first and second end portions and as between said first and second margin portions, wherein operationally when said first and second chambers and said primary interior have a portion of the fluid evacuated resulting in said surrounding sidewall becoming rigidified, said equilateral triangle areas will reduce in size causing said surrounding sidewall to shrink a greater distance as between said first and second margin portions and said surrounding sidewall will shrink a lesser distance as between said first and second end portions, for the purpose of compressing the sportboard with a greater force perpendicular to its lengthwise axis and compressing the sportboard with a lesser force parallel to its lengthwise axis for the purpose of a shrinking retention upon the sportboard at said sidewall first and second end portions at the narrowed ends of the sportboard along the lengthwise axis to better retain the sportboard along the lengthwise axis, such that operationally said particulate items are relatively movable to one another when said first and second chambers are in an un-evacuated state and said particulate items are substantially in contact with one another and also substantially immovable relative to one another when said first and second chambers and said primary interior are in an evacuated state forming a rigidified surrounding sidewall.

2. An encasement protective apparatus according to claim 1, wherein each of said particulate items are compressible.

3. An encasement protective apparatus according to claim 2, wherein each of said particulate items have a non-symmetric outer surface.

4. An encasement protective apparatus according to claim 1, wherein said single aperture further comprises a valve disposed therein, said valve is selectively able to be placed in an open or closed state, wherein said open state allows fluid flow therethrough said aperture and said closed state substantially prevents fluid flow therethrough said aperture.

* * * * *